US011761611B2

(12) United States Patent
Smets

(10) Patent No.: US 11,761,611 B2
(45) Date of Patent: Sep. 19, 2023

(54) LUMINAIRE SYSTEM WITH LEVERAGED DISPLACEMENT

(71) Applicant: Schreder S.A., Brussels (BE)

(72) Inventor: Paul Smets, Liege (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/414,040

(22) PCT Filed: Dec. 24, 2019

(86) PCT No.: PCT/EP2019/087022
§ 371 (c)(1),
(2) Date: Jun. 15, 2021

(87) PCT Pub. No.: WO2020/136202
PCT Pub. Date: Jul. 2, 2020

(65) Prior Publication Data

US 2022/0057071 A1 Feb. 24, 2022

(30) Foreign Application Priority Data

Dec. 24, 2018 (NL) ..... 2022296

(51) Int. Cl.
*F21V 14/06* (2006.01)
*F21V 5/00* (2018.01)
(Continued)

(52) U.S. Cl.
CPC ..... *F21V 14/06* (2013.01); *F21V 5/007* (2013.01); *F21V 17/02* (2013.01); *F21Y 2105/16* (2016.08); *F21Y 2115/10* (2016.08)

(58) Field of Classification Search
CPC ..... F21V 14/02; F21V 14/06; F21V 5/007; F21V 17/02; F21Y 2105/16; F21Y 2115/10
See application file for complete search history.

(56) References Cited

U.S. PATENT DOCUMENTS

2012/0121244 A1* 5/2012 Stavely ..... F21V 14/06 362/232
2018/0031215 A1* 2/2018 Erdener ..... F21V 31/03
(Continued)

FOREIGN PATENT DOCUMENTS

CN 201748343 U * 2/2011 ..... F21V 14/06
CN 103363324 B 4/2016
(Continued)

OTHER PUBLICATIONS

Merriam Webster definition of "slender", accessed at https://www.merriam-webster.com/dictionary/slender on Dec. 1, 2022. (Year: 2022).*
(Continued)

*Primary Examiner* — Erin Kryukova
(74) *Attorney, Agent, or Firm* — McDonnell Boehnen Hulbert & Berghoff LLP

(57) ABSTRACT

Example embodiments relate to luminaire systems with leveraged displacements. One embodiment includes a luminaire system. The luminaire system includes a first support. The luminaire system also includes a second support movable with respect to the first support. Additionally, the luminaire system includes a moving means configured for moving the second support relative to the first support. The moving means includes a lever mounted in a rotatable manner around a rotation axis. The moving means is configured to convert a rotation of the lever around said rotation axis into a movement of the second support relative to the first support. A plurality of light sources is arranged on one of the first support and the second support and is configured to emit light through one or more optical elements associated with the plurality of light sources and arranged on the other one of the first support and the second support.

18 Claims, 6 Drawing Sheets

(51) Int. Cl.

| | |
|---|---|
| ***F21V 17/02*** | (2006.01) |
| ***F21Y 105/16*** | (2016.01) |
| ***F21Y 115/10*** | (2016.01) |

(56) References Cited

U.S. PATENT DOCUMENTS

| | | | | |
|---|---|---|---|---|
| 2018/0245776 | A1* | 8/2018 | Gladden | F21V 7/04 |
| 2021/0172585 | A1* | 6/2021 | Boonekamp | F21V 14/06 |

FOREIGN PATENT DOCUMENTS

| | | | | | |
|---|---|---|---|---|---|
| DE | 202013101824 | U1 | | 7/2014 | |
| DE | 202015102145 | U1 | | 8/2016 | |
| EP | 3088799 | A1 | * | 11/2016 | F21V 14/06 |
| EP | 3239591 | A1 | * | 11/2017 | |
| JP | 2004355934 | A | | 12/2004 | |
| JP | 2008218084 | A | * | 9/2008 | |
| JP | 2008218084 | A | | 9/2008 | |
| WO | WO-2007007271 | A2 | * | 1/2007 | F21V 14/06 |
| WO | WO-2013127022 | A1 | * | 9/2013 | F21V 14/06 |
| WO | 2018028926 | A1 | | 2/2018 | |
| WO | WO-2018028926 | A1 | * | 2/2018 | F21V 17/005 |

OTHER PUBLICATIONS

PCT International Search Report and Written Opinion, Application No. PCT/EP2019/087022, dated Mar. 12, 2020, 12 pages.

* cited by examiner

LUMINAIRE SYSTEM WITH LEVERAGED DISPLACEMENT

CROSS-REFERENCE TO RELATED APPLICATIONS

The present application is a national stage entry of PCT/EP2019/087022 filed Dec. 24, 2019, which claims priority to NL 2022296 filed Dec. 24, 2018, the contents of each of which are hereby incorporated by reference.

FIELD OF INVENTION

The present invention relates to luminaire systems. Particular embodiments of the invention relate to a luminaire system with adjustable photometry.

BACKGROUND

Currently, in the luminaire production, it is necessary to design a specific printed circuit board (PCB) serving as a support for light sources together with a specific optical element type and shape for each luminaire application, e.g. pedestrian road, highway, one-way road, etc. The overall design depends notably on the desired lighting pattern on the surface to be illuminated, i.e. the desired shape of the light onto the illuminated surface. Such approach is costly, time consuming, and requires extensive stock keeping. It would therefore be advantageous to be able to design a luminaire system with a more adaptive approach for which the photometry can be modified on site and/or at the factory depending on the application and the desired light distribution.

Several solutions exist for outdoor lighting equipment presenting optical elements adjustable on an individual basis or within relatively restricted boundaries. However, the flexibility of use of the luminaire systems remains limited and there is a need for a luminaire system which can be adapted to each site and desired usage.

SUMMARY

The object of embodiments of the invention is to provide a luminaire system whose light distribution can be varied and which is more adaptable to a site to be illuminated and/or to a specific application. More in particular, embodiments of the invention aim to provide a luminaire system for which the photometry can be adjusted on site and/or at the factory.

According to a first aspect of the invention, there is provided a luminaire system. The luminaire system comprises:

- a first support;
- a second support movable with respect to said first support;
- a moving means configured for moving the second support relative to the first support, such that a position of the second support with respect to the first support is changed;
- wherein the moving means comprises a lever mounted in a rotatable manner around a rotation axis RA, said lever comprising a movable end portion configured for being rotated by a user or an actuator around said rotation axis RA, said movable end portion being located at a distance from the rotation axis RA;

- wherein the moving means is further configured to convert a rotation of the lever around said rotation axis RA into a movement of the second support relative to the first support;
- wherein a plurality of light sources is arranged on one of the first support and the second support, and is configured to emit light through one or more optical elements associated with the plurality of light sources and arranged on the other one of the first support and the second support.

A common solution to adapt a luminaire system to a specific use or site is to mount optical elements specified for the corresponding use or site. Installing different optical elements depending on the site and/or desired use makes the installation task unnecessarily complicated. Moreover, it adds the disadvantage of having to store several optical element types for production and/or for maintenance. This problem is overcome by a luminaire system as defined above.

The light emitted by the plurality of light sources arranged on one of the first support and second support will be influenced in a certain manner by the one or more optical elements comprised on the other one of the first support and the second support and associated with the plurality of light sources. Having the plurality of light sources and the one or more optical elements on different supports allows making independent the positioning of one with respect to the other. Indeed, the moving means will allow altering their relative positioning. In such a way, the emitted light and its distribution may be correlated to different relative positions of the one or more optical elements with respect to the positions of the plurality of light sources. The light distribution of the luminaire system can be adapted more easily to different sites and/or applications without having to mount different optical components. More in particular, embodiments of the invention allow a dynamic adaptation of the light distribution of the luminaire system based, for example, on changes occurring in its environment. By light distribution, it is meant the light envelope in space, formed by the light emitted by the plurality of light sources through the one or more optical elements, and which represents the emission directions and the intensity variations of the light through the one or more optical elements.

Due to the distance between a movable end portion of the lever and the rotation axis of the lever, a movement of the second support with respect to the first support is controlled through a leverage mechanism. Since the lever is mounted in a rotatable manner, a potentially complex movement of the first support relative to the second support or a simpler movement, e.g. a translation, may be transposed simply into a rotational movement. Rotational movement can be controlled reliably and precisely to achieve the desired illumination from the luminaire system. The presence of the lever as part of the moving means allows the adjustment of the position of the second support with respect to the first support to be carried out easily on site and/or at the factory by the user. Also, it requires less space in the luminaire system.

Preferably, the luminaire system is included in a luminaire head. The first support may be fixed in the luminaire system, preferably in said luminaire head. This arrangement allows heat dissipation of the first support via thermal contact with the luminaire head. Alternatively, the first support may move in the luminaire system independently from the movement of the second support relative to the first support.

Preferred embodiments relate to a luminaire system of an outdoor luminaire. By outdoor luminaire, it is meant luminaires which are installed on roads, tunnels, industrial plants, campuses, parks, cycle paths, pedestrian paths, or in pedestrian zones for example, and which can be used notably for the lighting of an outdoor area, such as roads and residential areas in the public domain, private parking areas and access roads to private building infrastructures, etc.

According to a preferred embodiment, the first support is fixed in the luminaire system.

According to a preferred embodiment, the first support comprises said plurality of light sources and the second support comprises one or more optical elements associated with the plurality of light sources.

In this way, the first support comprising said plurality of light sources may be fixed in the luminaire system, and the second support comprising said one or more optical elements moves relative to the first support. This arrangement allows heat dissipation of the first support via thermal contact with a heat dissipative surface part of the luminaire system.

According to another preferred embodiment, the one or more optical elements comprise a plurality of lens elements associated with the plurality of light sources. Indeed, lens elements may be typically encountered in outdoor luminaire systems, although other types of optical elements may be additionally or alternatively present in such luminaire systems, e.g. reflector, backlight, prism, collimator, diffusor, and the like.

In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and optionally a collimator portion integrally formed with said lens portion, said collimator portion being configured for collimating light transmitted through said lens portion. Also, a lens element may be provided with a reflective portion or surface or with a diffusive portion.

Alternatively, the one or more optical elements could be a transparent or translucent cover having varying optical properties (e.g. variation of thickness, transparency, diffusivity, reflectivity, refractivity, colour, etc.) along the movement direction.

The distance between the extremity of the movable end portion and the rotation axis RA of the lever may be defined as a leverage distance LD. The ratio of the leverage distance with the maximum travelling distance of the second support with respect to the first support may be defined as a leverage ratio. Preferably, the leverage ratio of the lever is such that the travelling distance of the second support, comprising the one or more optical elements, with respect to the first support, is less than the corresponding travelling distance of the movable end portion of the lever. In this way, the light distribution can be more easily adjustable by the increased precision of the second support movement with respect to the first support given by the advantageous leverage ratio.

According to an embodiment wherein the second support comprises said one or more optical elements, optionally in combination with any one of the embodiments described above, the second support may comprise an optical plate integrating the one or more optical elements. Optionally, the optical plate may be carried by a frame. In another embodiment, the second support may be the optical plate without a frame. For example, when the optical plate is sufficiently rigid, it may be used without a frame. In yet another embodiment, the plurality of optical elements may be separately formed and the second support may comprise a frame carrying the plurality of optical elements.

In this manner, the optical elements can be more easily replaced in case of maintenance. Also, the moving of the optical plate/optical elements may be more easily achieved.

According to a preferred embodiment, the second support is arranged such that an optical element of the one or more optical elements extends over a corresponding light source of the plurality of light sources.

In this way, each light source of the plurality of light source has a light distribution patterned by a corresponding optical element, which provides a large range of flexibility with respect to the final lighting pattern emitted by the luminaire system.

According to an exemplary embodiment, the second support comprises an optical plate integrating the one or more optical elements, and optionally a frame, wherein the optical plate is carried by the frame. Also, the frame may carry multiple optical plates together integrating the plurality of optical elements. According to another exemplary embodiment, the frame may comprise a surrounding fixture and a plurality of crossing elements extending between edges of the surrounding fixture. When multiple optical plates are carried by the frame, the crossing elements may extend along adjacent edges of two adjacent lens plates. In another embodiment, the second support may be the optical plate without a frame. For example, when the optical plate is sufficiently rigid, it may be used without a frame. In yet another embodiment, the plurality of optical elements may be separately formed and the second support may comprise a frame carrying the plurality of optical elements.

According to another embodiment wherein the first support comprises said one or more optical elements, optionally in combination with any one of the embodiments described above, the first support may comprise an optical plate integrating the one or more optical elements. Optionally, the optical plate may be carried by a frame. In another embodiment, the first support may be the optical plate without a frame. For example, when the optical plate is sufficiently rigid, it may be used without a frame. In yet another embodiment, the plurality of optical elements may be separately formed and the first support may comprise a frame carrying the plurality of optical elements.

Additionally, the one or more optical elements may further comprise one or more light shielding structures complying with different glare classifications, e.g. the G classification defined according to the CIE115:2010 standard, the G* classification defined according to the EN13201-2 standard. The light shielding structures may be configured for reducing a solid angle of light beams of the plurality of light sources by cutting off or reflecting light rays having a large incident angle, thereby reducing the light intensities at large angles and improving the G/G* classification of the luminaire system. The one or more optical elements may comprise on the one hand a lens plate comprising a plurality of lenses covering the plurality of light sources, and on the other hand one or more light shielding structures mounted on said lens plate. In such an embodiment, the lens plate and the one or more shielding structures form a second support which is movable relative to the first support.

In one embodiment, the light shielding structures may comprise a plurality of closed reflective barrier walls, each having an interior bottom edge disposed on said flat portion, an interior top edge at a height above said flat portion, and a reflective surface connecting the interior bottom edge and the interior top edge and surrounding one or more associated lenses of said plurality of lenses. The height may be at least 2 mm, preferably at least 3 mm. The interior bottom edge defines a first closed line and the interior top edge defines a second closed line. Preferably, the first closed line and the second closed line comprising at least one curved portion over at least 15%, preferably over at least 20%, more preferably over at least 25%, of a perimeter of said first closed line and a perimeter of said second closed line, respectively. The reflective surface is configured for reducing a solid angle Ω of light beams emitted through the one or more associated lenses of said plurality of lenses. Exemplary embodiments of shielding structures are disclosed in patent application NL2023295 in the name of the applicant which is included herein by reference.

In another embodiment, the light shielding structures may comprise a plurality of reflective barriers, each comprising a base surface disposed on said flat portion, a top edge at a height above said base surface, and a first reflective sloping surface connecting the base surface and the top edge and facing one or more associated lenses of said plurality of lenses. The first reflective sloping surface may be configured for reflecting light rays emitted through one or more associated first lenses of said plurality of lenses having a first incident angle with respect to an axis substantially perpendicular to the base surface between a first predetermined angle and 90°, with a first reflection angle with respect to said axis smaller than 60°. The first predetermined value may be a value below 90°. In other words, when the first incident angle is between the first predetermined value and 90°, the first reflective sloping surface reflects the incident ray such that the reflected ray has a reflection angle with respect to said axis smaller than 60°. According to an embodiment, at least one reflective barrier of the plurality of reflective barriers further comprises a second reflective sloping surface opposite the first reflective sloping surface, configured for reflecting light rays emitted through one or more associated second lenses of said plurality of lenses adjacent to the one or more first lenses associated with the first reflective sloping surface, having a second incident angle with respect to an axis substantially perpendicular to the base surface comprised between a second predetermined angle and 90°, with a second reflection angle with respect to said axis smaller than 60°. Exemplary embodiments of shielding structures are disclosed in patent application PCT/EP2019/074894 in the name of the applicant which is included herein by reference.

According to a preferred embodiment, a lens element of the plurality of lens elements has a first surface and a second surface located on opposite sides thereof, wherein the first surface is a convex or planar surface and the second surface is a concave or planar surface facing a light source of the plurality of light sources.

According to an exemplary embodiment, a lens element of the plurality of lens elements has an internal surface facing a light source of the plurality of light sources and an external surface. The internal surface and/or the external surface may comprise a first curved surface and a second curved surface, said first curved surface being connected to said second curved surface through a connecting surface or line comprising a saddle point or discontinuity. The second support is movably arranged relative to the first support to position the light source either in at least a first position facing the first curved surface or in at least a second position facing the second curved surface. When the external surface is implemented as described, preferably the external surface comprises a first outwardly bulging surface, a second outwardly bulging surface, and an external connecting surface or line connecting said first and second outwardly bulging surfaces. However, it is also possible to have any type of outer surface, such as a continuous outer surface, and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from an associated light source. An outwardly bulging external surface forms a protruding portion, whilst an outwardly bulging internal surface forms a cavity facing an associated light source.

By providing such curved surfaces, the lens element is given a "double bulged" shape allowing to generate distinct lighting patterns depending on the position of the light source with respect to the lens element. More in particular, the shape, the size and the location of the light beam may be different depending on the position of the light source with respect to the lens element. This will allow illuminating various types of sites, e.g. various types of roads or paths, with the same luminaire head. Also, this will allow adjusting a lighting pattern in function of the height at which the luminaire system is located above the surface to be illuminated.

Preferably, each lens element has a circumferential edge in contact with the first/second support, and the internal connecting surface or line is at a distance of the first/second support, depending on which one of the first support and the second support comprises the lens elements.

Preferably, the first outwardly bulging surface and the first/second support delimit a first internal cavity, the second outwardly bulging surface and the first/second support delimit a second internal cavity, and the internal connecting surface or line and the first/second support delimit a connecting passage between the first and second internal cavity. Such a connecting passage will allow a light source to pass from the first to the second cavity and vice versa. Preferably, a first maximal width (w1) of the first internal cavity, and a maximal second width (w2) of the second internal cavity are bigger than a third minimal width (w3) of the connecting passage between the first and second internal cavity. The first and second maximal width and the third minimal width extend in the same plane, preferably an upper plane of the first/second support, in a direction perpendicular on the moving direction. The first and second maximal width may also be different. The widths are measured in a lower plane of the lens element, delimiting the open side of the cavities, and the maximal width corresponds with a maximal width in this plane. When the lens element is supported on the first support, this plane corresponds with a surface of the first support.

Preferably, the first curved surface is at a first maximal distance of the first/second support, the second curved surface is at a second maximal distance of the first/second support, and the saddle point or discontinuity is at a third minimal distance of the first/second support, said third minimal distance being lower than said first and second maximal distance. More preferably, the first and second maximal distance are different. Those characteristics may apply for the external and/or internal curved surfaces.

In an exemplary embodiment, the luminaire head has a fixation end configured for being attached to a pole, the first maximal distance defined above is larger than the second maximal distance defined above, and the lens element is arranged such that the first internal and/or external curved surface is closer to the fixation end of the luminaire head than the second internal and/or external curved surface.

In an exemplary embodiment, the lens element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, wherein the second edge is an edge near the connecting surface or line and the first edge is opposite the second edge, away from the connecting surface or line. Alternatively or additionally, the light source may be provided with a reflective element. By using one or more reflective elements, the light may be directed to the street side of the luminaire in a more optimal manner.

The first and/or second curved surfaces may have a symmetry axis parallel to the moving direction. In exemplary embodiments, both the first and second curved surfaces may have a symmetry axis parallel to the moving direction. However, it is also possible to design the first curved surfaces with a symmetry axis whilst giving the second curved surfaces an asymmetric design or vice versa, or to design both the first and the second curved surfaces in an asymmetric manner. This will allow to obtain a symmetrical light beam in a first position of the light source relative to the lens element, and to obtain an asymmetrical light beam in a second position of the light source relative to the lens element.

In the examples above a lens element comprises two adjacent curved surfaces bulging outwardly, but the skilled person understands that the same principles can be extended to embodiments with three or more adjacent curved surfaces bulging outwardly. Also, it is possible to provide a lens element with an array of bulged surfaces, e.g. an array of n x m bulged surfaces with n>=1 and m>=1.

According to an exemplary embodiment, the rotation axis is substantially perpendicular to the first support.

In this manner, the footprint of the lever is minimized in the plane of the first support which saves space. The moving means may comprise conversion portions to convert the rotation of the lever into the movement of the second support with respect to the first support. The movement of the second support relative to the first support in the movement plane may be a translational movement in a plane parallel to the surface of the first support, or a more complex movement in a movement plane, e.g. zig-zag, S-shaped, curved, with an acute angle, a vertical movement, a rotational movement or any combination thereof.

In another exemplary embodiment, there may be a first and a second moving means comprising conversion portions, said first moving means being configured to move the second support relative to the first support along a first trajectory, and said second moving means being configured to move, independently from the first moving means, the second support relative to the first support along a second trajectory.

Conversion of movements may be mechanically simpler if the axes of the converted movement before and after the conversion are either coaxial or perpendicular. Having the rotation axis substantially perpendicular to the first support may be advantageous for a vertical movement of the second support with respect to the first support and for movement in a movement plane substantially parallel to the first support.

Note that, for the second support to move respective to the first support, the lever needs to be coupled with respect to the first or second support. In one embodiment, a rotatable shaft of the lever is coupled to a housing portion of the luminaire system. In another embodiment, the lever rotatable shaft is coupled directly to the first support or to the second support.

According to a preferred embodiment, a leverage distance between the movable end portion of the lever and the rotation axis is at least two times, preferably at least five times, more preferably at least ten times bigger than a maximum travel distance of the movement of the second support relative to the first support.

In this way, the larger the leverage distance, the more precise will be the resulting positioning of the second support with respect to the first support, and the better the luminaire system could fit to the desired use and/or site.

According to an exemplary embodiment, the movable end portion is an elongate element extending in a direction substantially perpendicular to the rotation axis.

In this manner, the force conversion from the user to the movement of the second support with respect to the first support will be more efficient. Additionally, the lever having the elongate element extending as defined will have a more compact shape for an equivalent leverage distance than, for example, a lever having an elongate element extending obliquely with respect to the rotation axis.

By having the moving means comprising a lever, the actuation of the moving means may be redirected towards a more favourable location. The more favourable location may be, for example, a location outside a luminaire head of the luminaire system reachable by an operator, a location outside a compartment inside the luminaire head, or may be a location of another component linked to the moving means inside the luminaire head of the luminaire system. Preferably, the first support is fixed in the luminaire system and the movement of the second support relative to the first support is controlled through the lever. The lever may be provided such that the emitted light is not blocked by the lever. According to a preferred embodiment, the luminaire system further comprises one or more positioning elements; and the moving means is configured for cooperating with the one or more positioning elements to position the second support with respect to the first support in a plurality of predetermined positions.

In this way, the second support is positioned relative to the first support at known positions that are correlated to different arrangements of the second support relative to the first support. It has the advantage that predetermined arrangements can be achieved reliably, which in turn saves time during the setting of the luminaire system. The one or more positioning elements allows precise and stable positioning of the moving means. Preferably, the one or more positioning elements allows setting the lever in a specific position. The skilled person will understand that the one or more positioning elements may be implemented in or on a large variety of parts of the luminaire system, e.g. housing, first support, or second support.

The one or more positioning elements may be discrete positioning elements or continuous positioning elements. Discrete positioning elements allow positioning the moving means at given predetermined positions with high accuracy and high repeatability. Examples of discrete positioning elements may be dips and/or bumps placed at regular intervals on a surface. Continuous positioning elements allow changing the positioning of the moving means in infinitesimally small steps which provides high tunability of the arrangement of the second support with respect to the first support. Examples of continuous positioning elements may be ramp elements, spiral-shaped elements, linear or circular channels, and the like.

In one embodiment, the one or more positioning elements is assisted by a spring to increase the force necessary to move from a first position to a second position and thereby increasing the positioning stability. The one or more positioning elements may be one or more depressions configured to cooperate with at least one protuberance, or the one or more positioning elements may be one or more protuberances configured to cooperate with at least one depression.

Alternatively the one or more positioning elements may be one or more protuberances configured to cooperate with a pair of protuberances designed to be located on either side of a protuberance of the plurality of protuberances. In yet another exemplary embodiment, the one or more positioning elements may comprise one or more magnet elements and/or ferromagnetic material configured to electromagnetically retain the moving means in the plurality of predetermined positions. The one or more magnet elements and/or ferromagnetic materials may be configured to cooperate with a corresponding positioning member of the lever comprising a magnet element and/or a ferromagnetic material.

Additionally, marks may be associated to the one or more positioning elements as a visual aid to the operator to determine the position of the moving means. Examples of marks may be letters, numbers, symbols, a scale. The marks may be provided to the lever arm and/or on the first and/or on the second support.

According to an exemplary embodiment, the one or more positioning elements is configured such that the plurality of predetermined positions corresponds with a plurality of lighting patterns on a surface, said plurality of lighting patterns having a plurality of different illuminated surface areas.

In this manner, the second support is positioned relative to the first support at known positions that are correlated to different light distributions resulting in different lighting patterns. The luminaire system is adaptable to a plurality of environments and/or applications matched with the plurality of lighting patterns. The plurality of lighting patterns may be systematically linked to the one or more positioning elements to be easily set by the operator.

According to an exemplary embodiment, the movement of the second support with respect to the first support comprises a translational movement.

In this manner, the relationship between conversion portions of the moving means configured to convert the rotation of the lever is mechanically simpler since the moving means transposes a rotation into a translation. It enables a better control of the movement of the second support relative to the first support and an improved predictability of the lighting pattern resulting from the emission of light through the optical elements. Preferably, the one or more optical elements have varying optical properties, e.g. shape, type, transparency, diffusivity, reflectivity, and/or refractivity, in a direction parallel to the translational movement of the second support.

According to a preferred embodiment, the movement of the second support with respect to the first support comprises a vertical movement.

In this way, the lighting pattern resulting from the emission of light through the optical elements can be changed by a simple distance change between the plurality of light sources and the corresponding plurality of optical elements. Preferably, the rotation axis of the lever is perpendicular to the first support. This would simplify the mechanism of the conversion portions of the moving means since the vertical movement of the second support with respect to the first support would be coaxial with the rotation axis of the lever. The distance between the first and second supports may be controlled by a plurality of spring elements arranged between the first and second supports such that the second support is substantially parallel to the first support.

According to another exemplary embodiment, the rotation axis of the lever may be parallel to the first support, or may be arranged at any predetermined angle with respect to the first support.

According to an exemplary embodiment, the lever is coupled to the first or second support.

In this manner, the movement of the second support with respect to the first support is stabilized since the number of intermediate parts between the lever and the reference of movement is minimized. The lever may be a permanent part of the moving means. Alternatively, the lever may be detachable to enable a more compact design of the moving means, and may be provided to the first or second support via a plug portion of the moving means.

According to another embodiment, the lever comprises a rotatable shaft rotatably received in a recess of the first of second support.

This can allow a mechanically simple and convenient implementation of the lever rotation.

According to a preferred embodiment, the rotation axis of the lever is fixed with respect to the first support.

In this way, the rotational movement of the lever is stabilized by having its rotation axis fixed with respect to the first support. Preferably, the first support is fixed to the luminaire system and the rotation of the lever is converted in a movement of the second support. To obtain a fixed axis with respect to the first support, a shaft of the lever may be coupled to the first support or to a surface mechanically fixed to the first support, e.g. a portion of the luminaire head of the luminaire system.

According to an exemplary embodiment, the rotation axis of the lever is substantially perpendicular to the movement plane of the second support with respect to the first support.

In this manner, the conversion portions of the moving means are mechanically simpler since it is preferable for the axes of the converted movement before and after the conversion to be perpendicular. As a result, the precision of movement of the moving means is improved, and the moving means is more reliable. Additionally, it is simpler to predict the positioning of the second support with respect to the first support based on the rotation of the lever, as well as the resulting lighting pattern.

According to a preferred embodiment, the lever extends through a wall of a compartment of a luminaire head of the luminaire system such that the movable end portion can be moved from outside the compartment of the luminaire head.

In this way, the lever is accessible by the user or to an actuator without opening the compartment. The compartment may be a compartment inside the luminaire head or it can be the housing of the luminaire head. Thus, changing the position of the second support with respect to the first support may be made easier, which reduces adjustment time either on site or in the factory.

Additionally, the lever may extend through a passage in the wall of the compartment, said passage being provided with a sealing means configured for sealing the passage such that water ingress is prevented during rotation of the lever. In doing so, the movement of the second support relative to the first support may be achieved while preserving the water integrity, e.g. rated at IP66, of the compartment, thereby protecting electrical circuits contained in the compartment.

The lever may extend through the wall of the compartment of the luminaire head partially or totally. When extending partially, only part of the lever may extend through the wall such that the movable end portion is accessible by the user from outside the compartment. When extending totally, the entirety of the lever is outside the compartment and the passage may surround the rotation axis of the lever for example.

According to an exemplary embodiment, the luminaire system further comprises a guiding means configured for guiding the movement of the second support with respect to the first support.

In this manner, the movement of the second support is further controlled along a predetermined trajectory, which results in a greater accuracy of the positioning of the optical elements respective to the light sources, or of the positioning of the light sources respective to the optical elements. The guiding means may comprise a first sliding guide and a second sliding guide at opposite side edges of the first or second support. This arrangement facilitates the guiding of the movement of the second support relative to the first support. Alternatively, one of the first and second sliding guides may be arranged on the first support, and the other one of the first and second sliding guides may be arranged on the second support. In yet another exemplary embodiment, the movement of the second support with respect to the first support may include a displacement being simultaneously or alternately along two or more perpendicular axes of the movement plane and the guiding means may comprise a plurality of guiding members configured for guiding the second support with respect to the first support along the two or more perpendicular axes.

According to an exemplary embodiment, the guiding means is further configured to guide the movement of the second support with respect to the first support along a combination of said first trajectory and said second trajectory. For example, a plurality of square or star/cross-shaped slits may be arranged in the second support, and the guiding means may comprise guiding elements extending through said square or star/cross-shaped slits and fixed to the first support and/or to a fixed component of the luminaire system.

According to a preferred embodiment, the guiding means is integrally formed with the first and/or second support.

In this way, fewer parts are needed to form the guiding means. It facilitates the assembly of the luminaire system and can save space. It can also facilitate the manufacturing of the first and/or second supports, especially if it is achieved through a moulding process.

According to an exemplary embodiment, the guiding means comprises a plurality of elongated guiding holes located in the second support.

In this manner, the guiding means is implemented in a simple manner Additionally, fixation means used to assemble the first and second support can pass through the plurality of guiding holes which serves the double purpose of guiding and fixation. The fixation means may be attached to a component of the luminaire system e.g. to a heat sink or housing.

According to another embodiment, the lever comprises an eccentric element cooperating with a guiding element of the first or second support. The eccentric element is centered around an eccentric axis EA parallel to the rotation axis RA of the lever.

This can allow a continuous movement of the first support relative to the second support. The cooperation of the eccentric element and the guiding element will define the overall movement of the first support with respect to the second support. Using a mechanism relying on the eccentric element may enable reducing the number of moving parts as part of the conversion mechanism.

In one embodiment, the rotation axis RA of the lever may be perpendicular to the first support and the conversion mechanism of the moving means may comprise a first and a second conversion portion, the eccentric element comprised by the first conversion portion cooperating with the guiding element comprised by the second conversion portion. A straight opening extending in the second support may forms the guiding element. When mounted, the eccentric element may extend through the guiding element. The lateral dimension of the guiding element perpendicular to the main direction may have a similar dimension as the diameter of the eccentric element. By rotating the lever, the rotational movement of the eccentric element with respect to the rotation axis RA of the rotatable shaft may be decomposed in two translational movements: a translational movement of the eccentric element with respect to the second support, a translational movement of the second support with respect to the first support.

According to a preferred embodiment, the movable end portion comprises a ferromagnetic material or a magnet.

In this way, the mechanism of the moving means can be actuated remotely by the electromagnetic coupling of an actuating key used by the user and the movable end portion.

According to an exemplary embodiment, the lever and the luminaire system are configured such that the lever is rotatable by means of a magnet element or a ferromagnetic material at a distance from the luminaire head of the luminaire system.

In this manner, the mechanism of the moving means is protected inside the luminaire head of the luminaire system. Moreover, changing the position of the second support with respect to the first support is made easier since opening the luminaire system housing is not required anymore, which reduces adjustment time on site and/or in the factory.

According to a preferred embodiment, the moving means comprises a rotating actuator, preferably a stepper motor. According to another exemplary embodiment, the moving means comprises a bi-metal.

In this way, motion of the moving means can be carried out in a precise manner.

According to an exemplary embodiment, the luminaire system may further comprise a controlling means configured to control the moving means, such that the position of the second support with respect to the first support is controlled.

In this manner, moving the second support with the moving means is more precise for the positioning of the plurality of light sources or the positioning of the one or more optical elements. A greater precision of the movement will lead to a greater light distribution adaptability of the luminaire system.

According to an exemplary embodiment, the controlling means is configured to control the moving means to position the second support in a plurality of positions relative to the first support, resulting in a plurality of lighting patterns on a surface, said plurality of lighting patterns having a plurality of different illuminated surface areas. A sensor may be located on the moving means or on the first or second support so as to determine the position of the second support with respect to the first support. In addition, a feedback loop may allow a more precise positioning of the plurality of optical elements respective to the plurality of light sources, or vice versa, by controlling the moving means based on data continuously or regularly supplied by the sensor.

According to an exemplary embodiment, the luminaire system further comprises a sensing means. The sensing means may comprises any one or more of a presence sensor, an ambient light sensor, an ambient visibility sensor, a traffic sensor, a dust particle sensor, a sound sensor, an image sensor such as a camera, an astroclock, a temperature sensor, a humidity sensor, a ground condition measurement sensor such as a ground reflectivity sensor, a lighting pattern sensor, a speed detection sensor.

According to a preferred embodiment, the luminaire system further comprises a sensing means configured to acquire a measure for a position of the second support relative to the first support. The controlling means may be configured to control the moving means in function of the acquired measure.

In this manner, the sensing means can obtain the position of the second support relative to the first support and a specific desired light distribution corresponding to a specific position of the second support can be achieved by the movement of the second support with respect to the first support controlled by the controlling means.

According to an exemplary embodiment, the luminaire system further comprises an environment sensing means configured to detect environmental data. The controlling means may be configured to control the moving means in function of the detected environmental data. In another embodiment, the environment sensing means may be provided to another component of a luminaire, e.g. to a pole of the luminaire, or in a location near the luminaire.

In this way, the environment sensing means can detect environmental data, e.g. luminosity, visibility, weather condition, sound, dynamic object (presence and/or speed), ground condition such as a ground reflectivity property, humidity, temperature, lighting pattern, time of the day, day of the year, of the surroundings of the luminaire system. The environment sensing means may already be provided to the luminaire system or may be added in a later phase of the luminaire system installation. Controlling the moving means in function of the detected environmental data may allow changing the light distribution, and thus the lighting pattern of the luminaire system in accordance with the detected environmental data in a more dynamic manner, e.g. compensating luminosity depending on weather or time of the day, changing to a lighting pattern more adapted for a passing cyclist.

According to a preferred embodiment, the luminaire system further comprises a pattern sensing means, e.g. a camera, configured to acquire a measure for a lighting pattern produced by the luminaire system. The controlling means may be configured to control the moving means in function of the acquired measure. In another embodiment, the pattern sensing means may be provided to another component of a luminaire, e.g. to a pole of the luminaire, or in a location near the luminaire.

In this manner, the pattern sensing means can acquire a measure of a lighting pattern associated with a corresponding position of the plurality of optical elements. Then, controlling the moving means in function of the acquired measure will enable a more adapted lighting pattern to be achieved relative to the current environment of the luminaire system. Further, acquiring a measure of the surface area associated with the lighting pattern will enable the correlation between a position of the one or more optical elements and the resulting lighting pattern.

In an embodiment with a feedback loop, the controlling means may correct, and more in particular may regularly or continuously correct the position of the plurality of optical elements respective to the plurality of light sources based on the sensed data, e.g. data from the pattern sensing means, data from the environment sensing means or data from a sensing means configured to acquire a measure for a position of the second support relative to the first support. It is noted that also data from any sensing means of nearby luminaire systems may be taken into account when correcting the position. Further, the data of the environment sensing means of one luminaire system may be used for controlling several nearby luminaire systems. For example, if a luminaire is positioned between two other luminaires, the lighting patterns thereof may partially overlap. The lighting pattern measured by the central luminaire may also be used to correct the position of the one or more optical elements respective to the plurality of light sources of the other two luminaires.

In this way, the luminaire system has a greater variety of light distributions and is more adaptable to different uses or sites.

The controlling means may be configured for controlling the rotating actuator of the moving means, a driver of the plurality of light sources, and optionally a dimmer, to control, e.g. the movement, and/or the light intensity, and/or a flashing pattern and/or the light colour and/or the light colour temperature. Preferably, the controlling means is configured to set a particular position of the second support relative to the first support in combination with a light intensity and/or light colour. In the context of the present application "light colour data" can refer to data for controlling a colour (e.g. the amount of red or green or blue) and/or data for controlling a type of white light (e.g. the amount of "cold" white or the amount of "warm" white). According to another exemplary embodiment the controlling means may be configured for controlling the moving means, driver, and optionally dimmer of more than one luminaire system.

According to an exemplary embodiment, the luminaire system may comprise a plurality of first light sources having a first colour and a plurality of second light sources having a second colour different from the first colour, said plurality of first and second light sources being arranged on one of the first support and the second support. The luminaire system may also comprise one or more optical elements arranged on the other one of the first and the second support and associated with the plurality of first and second light sources, said one or more optical elements being configured for mixing light emitted from the plurality of first and second light sources.

For example, a light source among the plurality of first light sources and a light source among the plurality of second light sources may be arranged on the first support, under a common optical element among the one or more optical elements arranged on the second support. The controlling means may be configured to set a first particular position of the second support relative to the first support corresponding to a first overall colour temperature and a first light distribution from the common optical element, and to set a second particular position of the second support relative to the first support corresponding to a second overall colour temperature and a second light distribution from the common optical element. In this way, the variation of said relative position enables to vary the overall colour temperature pattern or distribution of light through the common optical element together with the light distribution of said light.

Additionally, the controlling means may independently control the light intensity of the plurality of first light sources according to a first control profile and the light intensity of the plurality of second light sources according to a second control profile, thereby increasing the flexibility in adjusting the overall colour temperature of light through the common optical element.

The skilled person will understand that the hereinabove described technical considerations and advantages for luminaire system embodiments also apply to the below described corresponding luminaire systems network embodiments, mutatis mutandis.

According to a preferred embodiment, there is provided a luminaire systems network. The luminaire systems network comprises a plurality of luminaire systems preferably according to any one of the embodiments disclosed above, and a remote device. The plurality of luminaire systems may be comprised by one or more luminaire heads. The remote device is configured to send lighting data to the or each luminaire system. The controlling means of the or each luminaire system is further configured for controlling the moving means based on the lighting data received by the luminaire system. Lighting data may comprise e g dimming data, switching data, pattern data, movement data, light colour data, flashing pattern data, light colour temperature data, etc. For example, the movement data for a particular luminaire system may be determined by the remote device based on measurement data measured by one or more sensors associated with the luminaire heads. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

According to a preferred embodiment, an optical element of the one or more optical elements has an internal dimension, and the controlling means is configured to control the moving means such that the second support is moved relative to the first support over a distance below 90% of the internal dimension of the optical element, preferably below 50% of the internal dimension of the optical element.

In this manner, changes in the light distribution are achieved by changes in the profile or optical properties of an optical element in the direction of movement. Movements would only need to be limited such that the light emitted by the light sources is distributed in an adequate manner by the corresponding optical elements. The mentioned adequate manner can correspond to a movement whose distance is below 90%, preferably below 50%, of the internal dimension of the optical element such that the light sources can be kept in correspondence with their respective optical elements. Optical elements such as lenses and collimators may possess an internal dimension as defined above. In another embodiment, the luminaire system comprises more optical elements than light sources, and the controlling means is configured to control the moving means such that the second support is moved relative to the first support in a such a way that a given light source is moving from one optical element to another optical element.

According to a preferred embodiment, the second support is arranged such that an optical element of the one or more optical elements extends over a corresponding light source of the plurality of light sources.

According to a preferred embodiment, the light sources are arranged in a two-dimensional array of at least two rows and at least two columns.

In this way, the mounting and connecting of the plurality of light sources on the first support or on the second support is simplified. Similarly, the one or more optical elements may be arranged in a two-dimensional array of at least two rows and at least two columns. Further, different light sources may be arranged on the first/second support. For example, said light sources may have different colours or different colour temperatures. Further, different optical elements may be arranged on the second/first support, respectively. For example, said optical elements may have different shapes, or may comprise a transparent or translucent cover having different optical properties (e.g. differences of thickness, transparency, diffusivity, reflectivity, refractivity, colour, colour temperature, etc.) along the movement direction of the second support.

The skilled person will understand that the hereinabove described technical considerations and advantages for luminaire system embodiments also apply to the below described corresponding luminaire system assembly, mutatis mutandis.

According to another aspect of the invention, there is provided a luminaire system assembly. The luminaire system assembly comprises:

- a luminaire system as previously described;
- an actuating key comprising a magnet element or a ferromagnetic material, said actuating key being configured for rotating the lever around the rotation axis.

Preferred embodiment relate to a lever comprising a ferromagnetic material. The luminaire system may comprise a compartment, e.g. the housing of a luminaire head or a compartment inside the luminaire head, and the lever may extend away from the first and second supports to an inner surface of the compartment. In another exemplary embodiment, the shaft of the lever may extend away from the first and second supports such that the lever reaches the proximity of the inner surface of the compartment. A movable end portion of the lever in close proximity with the inner surface of the compartment may be provided with the ferromagnetic material. Placing an actuating key comprising a magnet element in close proximity with an outer surface of the compartment above the position of the ferromagnetic material comprised in the movable end portion allows remote electromagnetic coupling of the ferromagnetic material with the magnet element. Displacing the magnet element while keeping the electromagnetic coupling enables to actuate the lever without opening the luminaire system compartment. In another exemplary embodiment, the lever may comprise a magnet element configured to be coupled with a ferromagnetic material comprised in the actuating key located outside the luminaire system compartment. Additionally, the actuating key may comprise one or more magnet elements organized and/or shaped following a complex arrangement and configured for cooperating with a corresponding complex arrangement of the ferromagnetic material provided to the lever. In this way, only the user in possession of the actuating key may rotate the lever.

According to yet another aspect of the invention, there is provided a method for actuating a moving means of a luminaire system assembly. The method comprises:

- positioning an actuating key at a first position outside a luminaire head of the luminaire system, such that the actuating key is being coupled electromagnetically to the movable end portion of the lever;
- moving the actuating key from the first position to a second position outside the luminaire head of the luminaire system, such that the movable end portion of the lever is rotated around the rotation axis RA.

It will be understood by the skilled person that the features and advantages disclosed hereinabove with respect to embodiments of the luminaire system and the luminaire system assembly may also apply, mutatis mutandis, to embodiments of the method.

According to an exemplary embodiment, the method further comprises:

removing the actuating key from the second position outside the luminaire head of the luminaire system, such that the magnet element or the ferromagnetic material of the actuating key is electromagnetically decoupled from the ferromagnetic material or the magnet element comprised in the movable end portion of the lever.

In this way, the actuating key may be reused for adjusting the position of the second support with respect to the first support of another luminaire system. It is to be noted that the actuating key may be used for other purpose than actuating the lever of the luminaire system, e.g. unlocking a locking mechanism of a cabinet door, changing the orientation of a luminaire head via a magnetic moving means, changing the orientation of the light engine comprising the light sources within the luminaire head via a magnetic moving means, actuating other components of a luminaire system, and the like.

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

DESCRIPTION OF THE FIGURES

Figure 1:
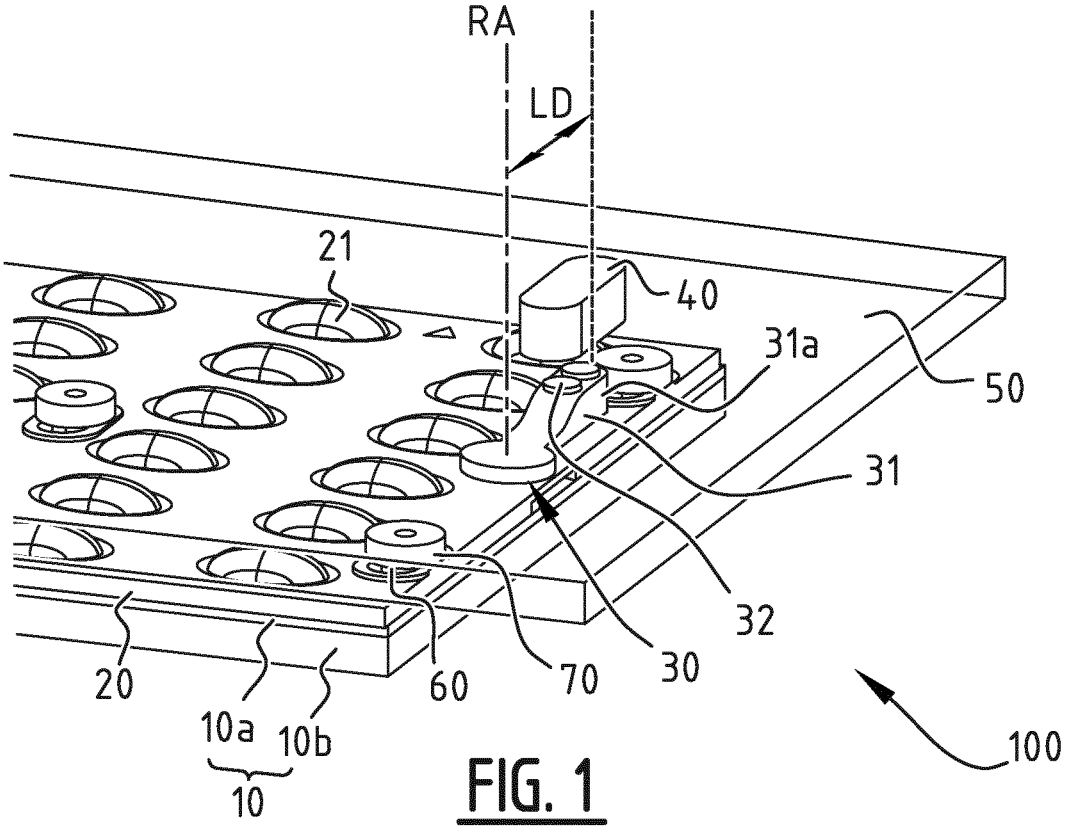
FIG. 1 shows a perspective view of an exemplary embodiment of a luminaire system assembly.

FIG. 1 shows a perspective view of an exemplary embodiment of a luminaire system assembly according to the present invention. The luminaire system assembly comprises a luminaire system 100 and an actuating key 40. The luminaire system 100 of FIG. 1 may be included in a housing of a luminaire head comprising a cover 50. The luminaire head may be connected in any manner known to the skilled person to a luminaire pole. Typical examples of such systems are street lights. In other embodiments, the luminaire head may be connected to a wall or another surface, e.g. for illuminating buildings or tunnels.

As illustrated in FIG. 1, the luminaire system 100 comprises a first support 10, a second support 20, and a moving means 30. The first support 10 is preferably fixed to the housing of the luminaire head and comprises a first surface and a second surface opposite said first surface. A plurality of light sources (not shown) may be arranged on one of the first support 10 and the second support 20 and is configured to emit light through one or more optical elements 21 associated with the plurality of light sources. The plurality of light sources may be arranged on the other one of the first support 10 and second support 20.

In the exemplary embodiment of FIG. 1, the first support 10 comprises the plurality of light sources mounted on the first surface. The first support 10 may comprise a supporting substrate 10*a*, e.g. a PCB, and a heat sink 10*b* onto which the supporting substrate may be mounted. The housing may be arranged around the first support 10 and may comprise a planar surface onto which the first support 10 is provided. The plurality of light sources may comprise a plurality of LEDs. Further, each light source of the plurality of light sources may comprise a plurality of LEDs, more particularly a multi-chip of LEDs; said light sources may be similar or may have different colours or different colour temperatures. In the embodiment of FIG. 1, the plurality of light sources corresponds to a plurality of light sources arranged in a two-dimensional array, for example an array of six rows by four columns. In other embodiments, the plurality of light sources may be arranged without a determined pattern, or in an array with at least two rows of light sources and at least two columns of light sources. It should be clear for the skilled person that the number of rows and columns may vary from one embodiment to another. The LEDs may be disposed on the PCB and mounted on top of a planar surface of the heat sink made of a thermally conductive material, e.g. aluminium. The surface onto which the plurality of light sources is mounted may be made reflective or white to improve the light emission. The plurality of light sources could also be lights other than LEDs, e.g. halogen, incandescent, or fluorescent lamp.

In the exemplary embodiment of FIG. 1, the second support 20 comprises one or more optical elements 21 associated with the plurality of light sources; said optical elements 21 may be similar or may have different shapes, or comprise a transparent or translucent cover having different optical properties (e.g. differences of thickness, transparency, diffusivity, reflectivity, refractivity, colour, colour temperature, etc.) along the movement direction of the second support 20. The one or more optical elements 21 correspond to a plurality of optical elements 21 arranged in a two-dimensional array associated with the plurality or light sources, for example an array of six rows by four columns. In other embodiments, the one or more optical elements 21 may be arranged without a determined pattern or in an array with at least two rows of optical elements 21 and at least two columns of optical elements 21. It should be clear for the skilled person that the number of rows and columns may vary from one embodiment to another. In other embodiments, some of the plurality of light sources may not be associated with an optical element 21. In the embodiment of FIG. 1, each optical element 21 of the plurality of optical elements extends over one corresponding light source of the plurality of light sources; the optical elements 21 are similar in size and shape. In another exemplary embodiment, at least one optical element 21 may not extend over a corresponding light source of the plurality of light sources. In another exemplary embodiment, some or all of the optical elements 21 may be different from each other. In a further exemplary embodiment, there may be more optical elements 21 than light sources. In yet other embodiments there may be provided a plurality of LEDs below each or some of the optical elements 21.

In the exemplary embodiment of FIG. 1, the second support 20 is movable with respect to the first support 10. It should be clear for the skilled person that in other exemplary embodiments the second support 20 may comprise a plurality of light sources mounted on a first surface, and that the first support 10 may comprise one or more optical elements 21 associated with the plurality of light sources. Hence, the configuration of the first support 10 and of the second support 20 is interchangeable in the present invention.

The one or more optical elements 21 may be part of an integrally formed optical plate comprised in the second support 20, as illustrated in FIG. 1. In other words, the one or more optical elements 21 may be interconnected so as to form an optical plate comprising the one or more optical elements 21. The optical plate may be formed, e.g. by injection moulding, casting, transfer moulding, or in another appropriate manner. Alternatively, the one or more optical elements 21 may be separately formed, e.g. by any one of the above mentioned techniques. The second support 20 may comprise a frame (not shown) and an optical plate integrating the one or more optical elements 21. The optical plate may be carried by the frame, or may be free-standing instead of being carried by the frame. The frame may be a rectangular plate with a first surface facing the plurality of light sources and a second surface opposite the first surface. In yet another embodiment, the plurality of optical elements may be separately formed and the second support may comprise a frame carrying the plurality of optical elements.

The one or more optical elements 21 may comprise a plurality of lens elements associated with the plurality of light sources, as illustrated in FIG. 1. At least one lens element of the plurality of lens elements may have a first surface and a second surface located on opposite sides thereof. The first surface is a convex surface and the second surface may be a concave surface, but may also be a planar surface, facing at least one light source of the plurality of light sources. Further, it should be clear for the skilled person that the one or more optical elements 21 may additionally or alternatively comprise other elements than lens elements, e.g. reflector, backlight element, collimator, diffusor, light shielding structure and the like.

At least one lens element of the plurality of lens elements may be free form in the sense that it is not rotation symmetric. In the embodiment of FIG. 1, the lens elements have a symmetry axis along an internal dimension of the lens elements. In another embodiment, the lens element may have no symmetry plane/axis at all. The internal dimension is defined as the dimension of the lens element on a side facing the plurality of light sources along a movement direction of the second support 20, as described in a later paragraph. The plurality of lens elements may have a maximum length different from a maximum width. Said length is defined as an internal dimension on a side facing the plurality of light sources as seen in the movement direction of the second support 20, and said width is defined as an internal dimension on a side facing the plurality of light sources as seen perpendicularly to the movement direction of the second support 20. The lens elements are in a transparent or translucent material. They may be in optical grade silicone, glass, poly(methyl methacrylate) (PMMA), polycarbonate (PC), or polyethylene terephthalate (PET). Further embodiments of lens elements are described with reference to FIGS. 5A-5B, and FIGS. 6A-6E The light distribution adaptability of the luminaire system 100 is made easier by the common movement of the plurality of light sources or of the one or more optical elements 21 rather than on an individual basis. At the same time, exemplary embodiments of the invention reduce the number of parts to be kept in stock for maintenance. In other embodiments, changing the position of the plurality of light sources or of the one or more optical elements 21 may be done to compensate for mounting or apparatus inaccuracies.

The movement of the plurality of light sources or of the one or more optical elements 21 is achieved thanks to the moving means 30. The moving means 30 comprises a lever 31 mounted in a rotatable manner around a rotation axis RA. The lever 31 may be coupled to one of the first support 10 or the second support 20. In FIG. 1, the lever 31 is configured for rotating around a rotation axis perpendicular to the first support 10. The rotation axis RA of the lever 31 may be fixed with respect to the first support 10. To achieve that, the lever 31 may comprise a rotatable shaft coupled to the first support 10 or to any other portion of the luminaire system 100 fixed with respect to the first support 10.

In the exemplary embodiment of FIG. 1, the rotatable shaft of the lever 31 extends through the second support 20 and is rotatably received in a recess or hole of the first support 10. In another exemplary embodiment, the rotation axis RA of the rotatable element 31 may be fixed with respect to the second support 20 instead of the first support 10. In yet other exemplary embodiments, the rotation axis may be parallel to the first support 10, or may be arranged at any predetermined angle with respect to the first support 10. In a non-illustrated embodiment, the lever 31 may be removable and may comprise a coupling portion configured for being coupled to a corresponding coupling member fixed with respect to the first or second support 10, 20.

As illustrated in FIG. 1, the lever 31 is coupled to the first support 10 and is located substantially at a lateral side of the first and second support 20. The lever 31 comprises a movable end portion 31*a* configured for being rotated by a user or an actuator. The movable end portion 31*a* may be an elongate element extending in a direction substantially perpendicular to the rotation axis RA to be more easily manipulated by the user. By rotating the movable end portion 31*a*, the user can actuate the moving means 30, thereby inducing the movement of the second support 20 with respect to the first support 10. In another exemplary embodiment, the lever 31 has a cylindrical portion centred around the rotation axis RA and the movable end portion 31*a* is located in periphery of the cylindrical portion. In still another exemplary embodiment, the lever 31 has at least two elongate elements centred on the rotation axis RA and extending in a direction substantially perpendicular to the rotation axis RA.

The moving means 30 may comprise conversion portions. The cooperation of the conversion portions may ensure the conversion of a rotational movement of the lever 31 into a movement of the second support 20 with respect to the first support 10. Depending on the design of the conversion portions, the skilled person will understand that various movements, e.g. translation, rotation, elevation, curved trajectory, trajectory with acute angles, of the second support 20 with respect to the first support 10 may be implemented by converting the rotational movement of the lever 31. An exemplary embodiment of a conversion portion comprising an eccentric element is described in reference to FIG. 4.

In another exemplary embodiment, there may be a first and a second moving means comprising conversion portions, said first moving means being configured to move the second support 20 relative to the first support 10 along a first trajectory, and said second moving being configured to move, independently from the first moving means, the second support 20 relative to the first support 10 along a second trajectory different from the first trajectory.

The second support 20 may be configured to move in contact with the upper surface of the first support 10. In the exemplary embodiment of FIG. 1, the second support 20 is kept in contact with the first support using a plurality of fixation means 70. The plurality of fixation means 70 extends through a plurality of elongated guiding holes 60 located in the second support 20. There are three visible elongated guiding holes 60 in FIG. 1, two elongated guiding holes 60 each located substantially at a corner of the rectangular-shaped second support 20, and one elongated guiding hole 60 located substantially at the centre of the second support 20. The plurality of elongated guiding holes 60 extends in a direction of movement of the second support 20 with respect to the first support 10, a translational movement in FIG. 1, and form guiding means to control the trajectory of the second support 20 movement.

In another exemplary embodiment, the second support 20 is mounted at a fixed distance from the first support 10, e.g. a PCB. To that end, the first support 10 may be provided with distance elements on which the second support 20 is movably supported. Optionally, a surface of the second support 20 facing the first support 10 may be provided with tracks or guides cooperating with the distance elements. Such tracks or guides may be formed integrally with the rest of the second support 10. Optionally, the distance elements may be adjustable in order to adjust the distance between the first support 10 and the second support 10. For example, the distance elements may comprise a screw thread cooperating with a bore arranged in/on the first support 10.

In yet another exemplary embodiment, the movement of the second support 20 with respect to the first support 10 may include a displacement being simultaneously or alternately along two or more perpendicular axes and the guiding means may comprise a plurality of guiding members configured for guiding the second support 20 with respect to the first support 10 along the two or more perpendicular axes.

To actuate remotely the moving means 30, the movable end portion 31*a* may comprise a ferromagnetic material 32 or a magnet element. In the exemplary embodiment of FIG. 1, the luminaire system 100 is included in a housing of a luminaire head comprising a cover 50 and the lever 31 extends upwardly to an inner surface of the cover 50. The movable end portion 31*a* of the lever 31 in close proximity with the inner surface of the cover 50 is provided with the ferromagnetic material 32. Placing the actuating key 40 comprising a magnet element in close proximity with an outer surface of the cover 50 opposite the position of the ferromagnetic material 32 allows remote electromagnetic coupling of the ferromagnetic material 32 with the magnet element. Displacing the actuating key 40 while keeping the electromagnetic coupling enables to actuate the moving means 30 without opening the luminaire system housing 50. Removing the actuating key 40 such that it is electromagnetically decoupled with the movable end portion 31*a* stops the movement of the second support 20 with respect to the first support 10. It is to be noted that the actuating key 40 may be used for other purpose than actuating the lever 31 of the luminaire system 100, e.g. unlocking a locking mechanism of a cabinet door, changing the orientation of a luminaire head via a magnetic moving means, changing the orientation of the light engine comprising the light sources within the luminaire head via a magnetic moving means actuating other components of a luminaire system 100, and the like.

Additionally, the actuating key 40 may comprise one or more magnet elements organized following a complex arrangement and configured for cooperating with a corresponding complex arrangement of the ferromagnetic material provided to the lever 31. In this way, only the user in possession of the actuating key 40 may rotate the lever 31. Alternatively, the movable end portion 31*a* may comprise a magnet element configured to be coupled with a ferromagnetic material located outside the luminaire head housing. In still another exemplary embodiment the moving means 30 comprises a rotating actuator located inside the housing, preferably a stepper motor, to rotate the lever 31. In yet another exemplary embodiment, the movable end portion 31*a* may be coupled to a bi-metal actuator.

The distance between the extremity of the movable end portion 31*a* and the rotation axis RA of the lever 31 is defined as a leverage distance LD. The ratio of the leverage distance LD with the maximum travelling distance of the second support 20 with respect to the first support 10 is defined as a leverage ratio. The leverage ratio may be at least equal to two, preferably at least equal to five, more preferably at least equal to ten. The larger the leverage ratio, the more accurate will be the positioning of the second support 20 with respect to the first support 10. In FIG. 1, the leverage distance LD is approximately ten times the maximum travelling distance of the second support 20 with respect to the first support 10.

Figure 2:
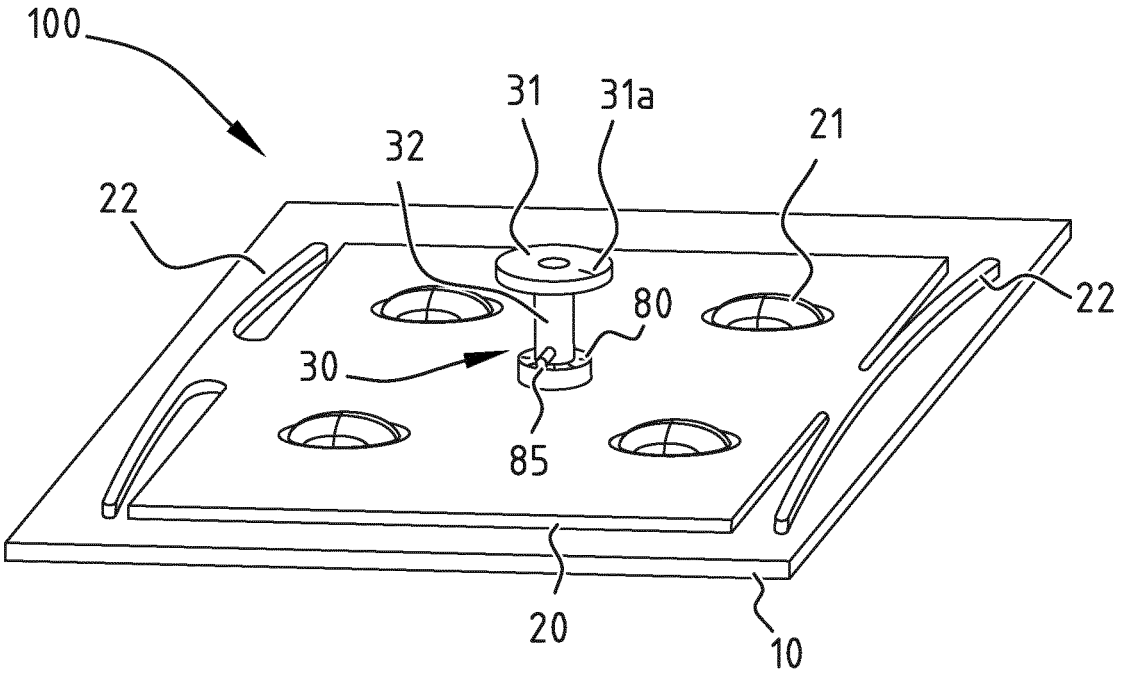
FIG. 2 shows a perspective view of an exemplary embodiment of a luminaire system.

FIG. 2 shows a perspective view of an exemplary embodiment of a luminaire system according to the present invention. As illustrated in FIG. 2, the luminaire system 100 comprises a first support 10, a second support 20, and a moving means 30. The first support 10 is preferably fixed to the housing of the luminaire head. A plurality of light sources may be arranged on one of the first support 10 and the second support 20, on the first support 10 in the embodiment of FIG. 2, and is configured to emit light through one or more optical elements 21 associated with the plurality of light sources and arranged on the other one of the first support 10 and second support 20, on the second support 20 in the embodiment of FIG. 2.

In the exemplary embodiment of FIG. 2, the moving means 30 comprises a rotatable portion 32 extending through an opening of the second support 20, said rotatable portion 32 being coupled to the first support 10. The moving means 30 is provided substantially at the centre of the first and second supports 10, 20.

The moving means 30 comprises a lever 31. The lever 31 of FIG. 2 is connected to an end of the rotatable portion 32, is facing the second support 20, and is shaped as a disk substantially coaxial with the rotatable portion 32.

Figure 7A:
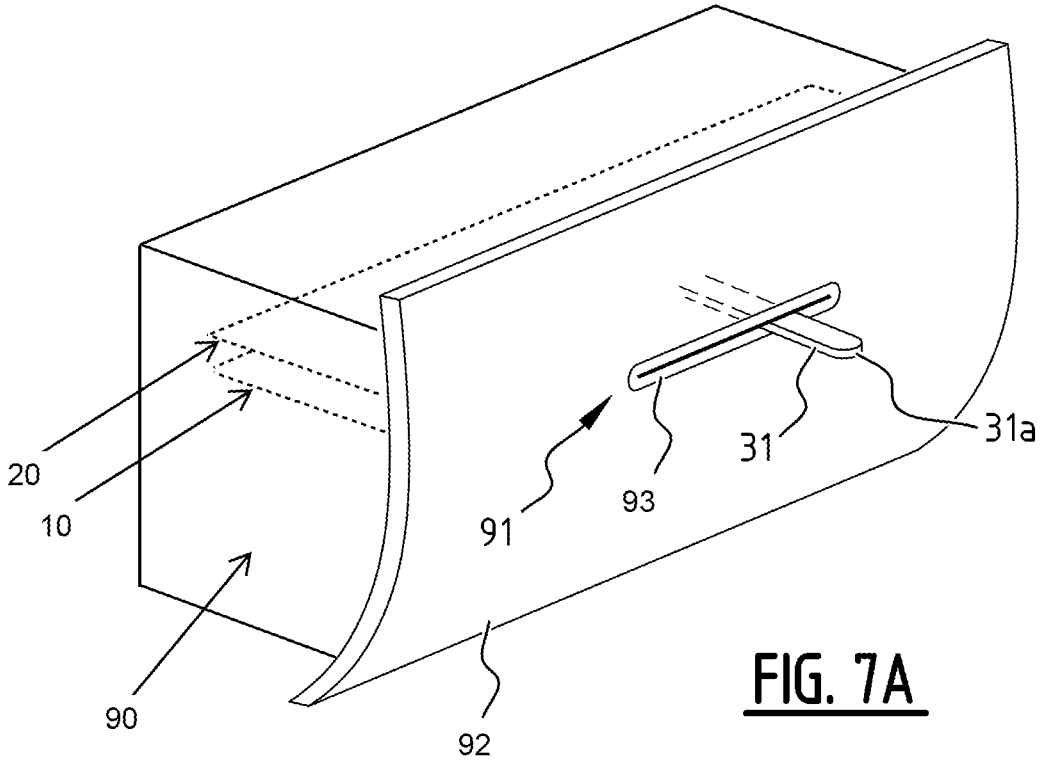
FIGS. 7A-7B schematically illustrate exemplary embodiments of a lever of a luminaire system.
Figure 7B:
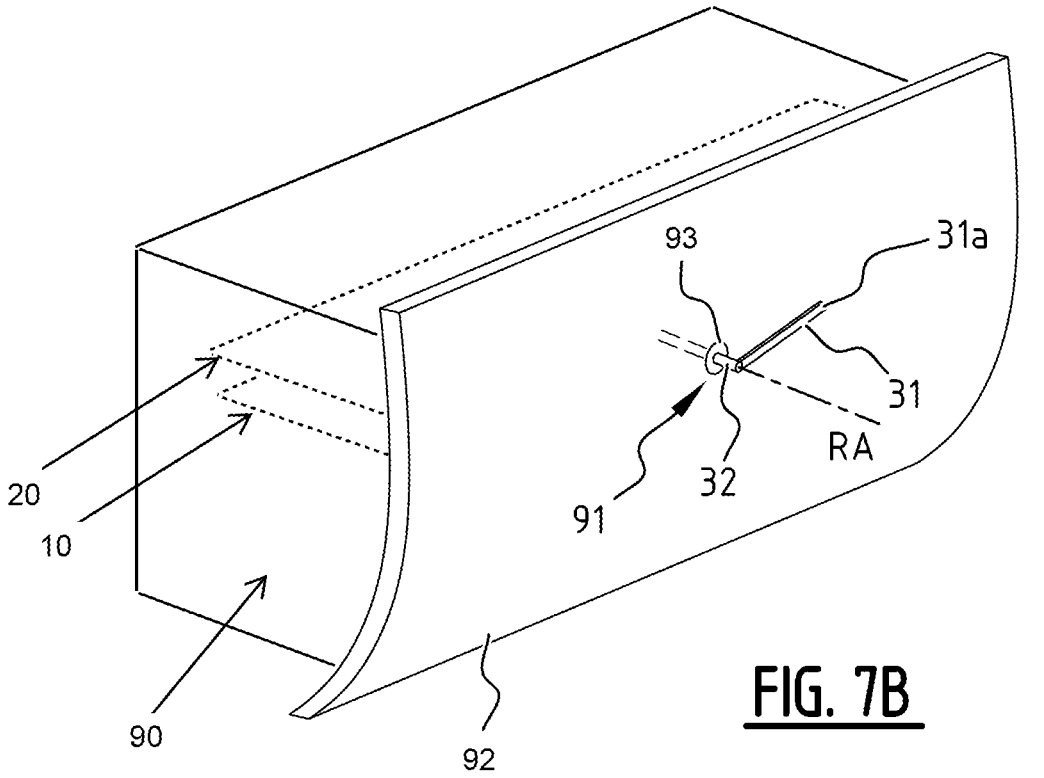

In an exemplary embodiment, and as can be seen in FIGS. 7A-7B, the lever 31 may extend through a passage 91 in the wall 92 of a compartment 90 of the luminaire head, e.g. the lighting compartment. The lever 31 may extend through the compartment such that it can be actuated by a user or an actuator from within the housing of the luminaire head or from outside the housing of the luminaire head. Additionally, the passage 91 in the wall 92 of the compartment 90 may be provided with a sealing means 93 configured for sealing the passage 91 such that water ingress is prevented during rotation of the lever 31. In doing so, the movement of the second support 20 relative to the first support 10 may be achieved while preserving the water tightness, e.g. rated at IP66, of the compartment, thereby protecting electrical circuits contained in the compartment. According to various embodiments, the lever 31 may extend through the wall 90 of the compartment of the luminaire head partially or totally. When extending partially, as illustrated in FIG. 7A, only part of the lever 31 may extend through the wall 92 such that a movable end portion 31*a* of the lever 31 is accessible by the user from outside the compartment 90. When extending totally, as illustrated in FIG. 7B, the entirety of the lever 31 is outside the compartment 90 and the passage 91 may surround the rotation axis RA of the lever 31. For example, the rotatable portion 32 may extend through the housing when mounted, and the lever 31 may be actuated by a user from outside the housing.

The lever 31 comprises a movable end portion 31*a*. The movable end portion 31*a* may be a slit in the top surface of the lever 31 configured for cooperating with a flathead screwdriver. Preferably, the leverage ratio of the lever 31 is such that the travelling distance of the second support 20, comprising the one or more optical elements 21, with respect to the first support 10 is less than the corresponding travelling distance of the movable end portion 31*a* of the lever. In this way, the light distribution can be more easily adjustable by the increased precision of the second support 20 movement with respect to the first support 10 given by the advantageous leverage ratio.

The second support 20 may comprise a plurality of lens elements 21, an array of two rows by two columns in FIG. 2, corresponding to the plurality of light sources. As illustrated in FIG. 2, the second support 20 may be provided with arc-shaped spring elements 22 extending substantially parallel to lateral sides of the second support 20. The spring elements 22 may be connected to the second support 20 via the central portion of their arc and have their free ends in contact with the top surface of the first support 10. The spring elements 22 may be configured such that they apply a pushing force away from the top surface of the first support 10 to maintain a predetermined distance between the plurality of lens elements 21 and the plurality of corresponding light sources arranged on the first support 10. The spring elements 22 may be integral with the second support 20. In another exemplary embodiment, the spring element 22 may be one or more coils arranged between the first and second supports 10, 20.

The rotatable portion 32 of the moving means may comprise one or more positioning elements 80. In the embodiment of FIG. 2, the rotatable portion 32 is provided with a ring-like element arranged against the top surface of the second support 20. The ring-like element has a plurality of notches 80 in a radial pattern, said plurality of notches forming the plurality of positioning element 80. The plurality of notches 80 may have increasing depths in a clockwise direction. In another exemplary embodiment, the plurality of notches 80 may have increasing depths in an anti-clockwise direction.

Alternatively, the one or more positioning elements 80 may comprise one or more protuberances cooperating with at least one corresponding depression or protuberance. In yet another exemplary embodiment, the one or more positioning elements 80 may comprise a continuous ramp element, a spiral-shaped element centred around the rotation axis of the rotatable portion 32, a linear or circular channel, and the like. In still yet another exemplary embodiment, the one or more positioning elements 80 may comprise one or more magnet elements and/or ferromagnetic materials such as to electromagnetically retain the moving means in the plurality of predetermined positions.

The ring-like element may be fixed with respect to the second support 20. The rotatable portion 32 may be provided with a bayonet 85 extending perpendicularly with respect to the rotation axis of the rotatable portion 32 and fixed to the rotatable portion 32. The bayonet 85 may be configured for cooperating with the plurality of positioning element 80.

Rotating the lever 31 using the movable end portion 31*a* allows changing the bayonet 85 position from a first notch of the plurality of notches 80 to a second notch of the plurality of notches 80. Additionally or alternately, any other positioning element may be used. Due to the spring elements 22, the second support 20 may be pushed away from the first support. The bayonet 85 cooperating with the plurality of notches 80 stops the second support 20 from being pushed past a predetermined distance from the first support 10. By changing from the first notch to the second notch, said first and second notches having different depths, the predetermined distance is changed. Thus, the plurality of notches 80 may correspond to a plurality of distances between the plurality of optical elements 21 and the corresponding plurality of light sources. In this way, the second support 20 may be positioned relative to the first support 10 at known positions/distances that are correlated to different light distributions. It has the advantage that predetermined light distributions can be achieved reliably, which in turn saves time during the setting of the luminaire system 10. The one or more positioning elements 80 allows precise and stable positioning of the moving means.

Additionally, marks may be associated to the one or more positioning elements 80 as a visual aid to the operator to determine the position of the moving means. Examples of marks may be letters, numbers, symbols, a scale. The marks may be provided to the first support 10, the second support 20, and/or the lever arm.

Figure 3:
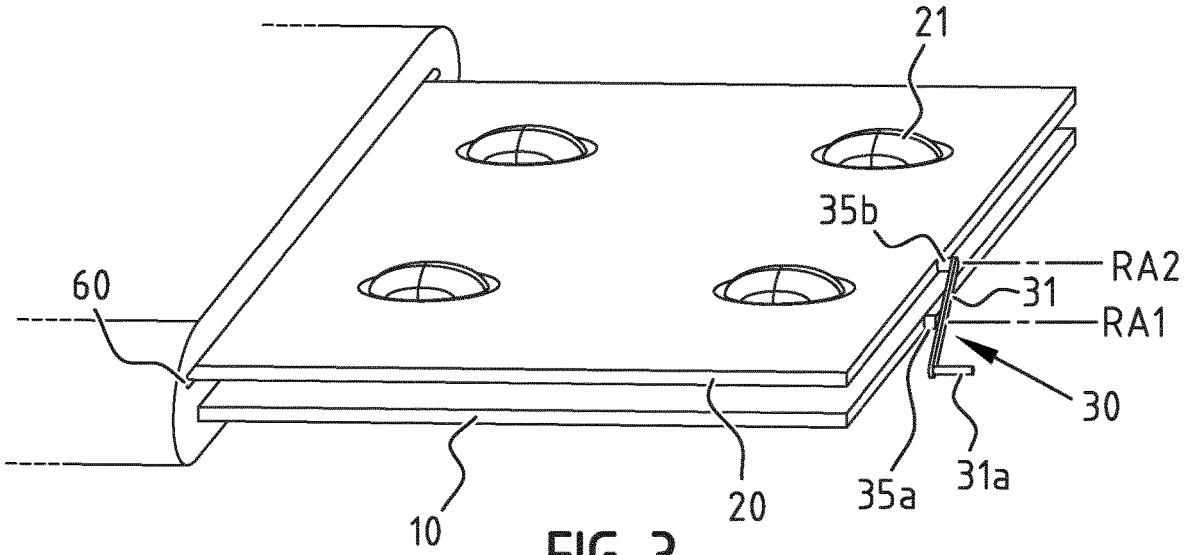
FIG. 3 shows a perspective view of another exemplary embodiment of a luminaire system.

FIG. 3 shows a perspective view of another exemplary embodiment of a luminaire system according to the present invention. As illustrated in FIG. 3, the luminaire system 100 comprises a first support 10, a second support 20, and a moving means 30. The first support 10 is preferably fixed to the housing of the luminaire head. A plurality of light sources may be arranged on one of the first support 10 and the second support 20, on the first support 10 in the embodiment of FIG. 3, and is configured to emit light through one or more optical elements 21 associated with the plurality of light sources and arranged on the other one of the first support 10 and second support 20, on the second support 20 in the embodiment of FIG. 3.

The second support 20 may comprise a plurality of optical elements 21 and may be mounted at a distance from the first support 10. A plurality of spring elements (not shown) arranged between the first and second supports 10, 20 may maintain the second support 20 substantially parallel to the first support 10 at a predetermined distance. The luminaire system 100 may comprises guiding means 60, a sliding guide 60 in FIG. 3. A lateral side of the second support 20 may be arranged along the sliding guide 60 such that its movement is guided. The movement of the second support 20 is further controlled along a trajectory substantially parallel to the first support 10, which results in a greater accuracy of the positioning of the optical elements 21 respective to the light sources. In another exemplary embodiment, the guiding means 60 may comprise a first sliding guide and a second sliding guide at opposite side edges of the first or second support. This arrangement may facilitate further the guiding of the movement of the second support 20 relative to the first support 10. In yet another exemplary embodiment, the guiding means 60 may be integrally formed with the first 10 or second support 20.

The moving means 30 comprises a lever 31. As illustrated in FIG. 3, the lever 31 is provided to a lateral side of the first 10 and second supports 20 opposite the sliding guide 60. The lever comprises a connecting portion coupled to the first and second supports 10, 20 via a first and second shafts 35*a*, 35*b*, respectively, said first and second shafts 35*a*, 35*b* extending substantially parallel to the first and second supports 10, 20. The lever 31 is configured for rotating around a first rotation axis RA1 with respect to the first support 10, and for rotating around a second rotation axis RA2 with respect to the second support 20.

The lever 31 comprises a movable end portion 31*a* extending substantially perpendicularly with respect to the connecting portion. Preferably the movable end portion 31*a* is at a distance from the first rotation axis RA1 in order for leverage to be created when the first support 10 is fixed relative to the housing of the luminaire head. Actuating the moving means 30 by rotating the lever 31 induces a translational movement of the second support 20 with respect to the first support 10 along the guiding direction of the sliding guide 60. Since the lever 31 has a rotational movement and the second support has a translational movement, the first shaft 35*a*, second shaft 35*b*, and/or movable end portion may be mounted on a slider configured for sliding along the main direction of the lever 31 to convert the remaining movement of the lever 31.

Figure 4:
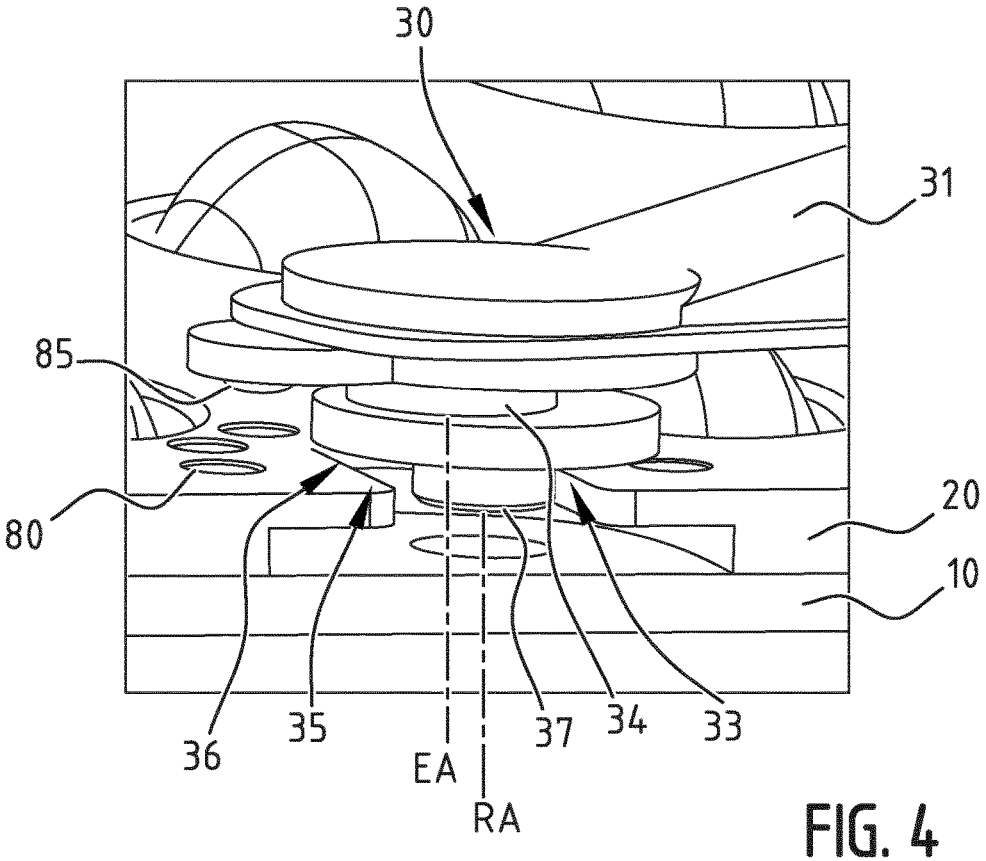
FIG. 4 illustrates an exploded view of an exemplary embodiment of a moving means of a luminaire system.

FIG. 4 illustrates an exploded view of an exemplary embodiment of a moving means of a luminaire system according to the present invention. The luminaire system 100 comprises a first support 10, a second support 20, and a moving means 30.

The moving means 30 comprises a lever 31. As illustrated in FIG. 4, the lever 31 comprises a rotatable shaft 37 coupled to the first support 10 and is located substantially at a lateral side of the first and second supports 10, 20. The conversion mechanism of the moving means 30 may comprise conversion portions 33, 35, in the FIG. 4 an eccentric element 34 comprised by the first conversion portion 33 cooperating with a guiding element 36 comprised by the second conversion portion 35.

The first conversion portion in FIG. 4 comprises a cylindrical element centred around the rotation axis RA of the rotatable shaft 37. Another cylindrical element placed off-centred and on top of the centred cylindrical element forms the eccentric element 34. The eccentric element 34 is centred around an eccentric axis EA.

The second support 20 is provided with an undercut in order to accommodate the centred cylindrical element of the rotatable shaft 37. An opening extends through the second support 20 and connects to the undercut. The opening extends in a direction perpendicular to the lateral side of the second support 20 and forms the guiding element 36. When mounted, the eccentric element 34 extends through the guiding element 36. The lateral dimension of the guiding element 36 perpendicular to the main direction has a similar dimension as the diameter of the eccentric element 34. The guiding element 36 has an open side on the lateral side of the second support 20.

The eccentric element 34 extends through the guiding element 36 when the second support 20 is mounted on the first support 10. Rotating the lever 31 from a first position to a second position of the plurality of predetermined positions will cause the translation of the second support 20 with respect to the first support 10 along a direction substantially parallel to the lateral side of the first and second supports 10, 20, and the translation of the eccentric element 34 along the main direction of the guiding element 36. Indeed, since the guiding element 36 extends substantially perpendicularly to said lateral side, the rotational movement of the eccentric element 34 with respect to the rotation axis RA of the rotatable shaft 37 is decomposed in two translational movements: a translational movement of the eccentric element 34 with respect to the second support 20, a translational movement of the second support 20 with respect to the first support 10.

The eccentric element 34 may be placed in a plurality of predetermined positions thanks to one or more positioning elements 80. In the exemplary embodiments of FIG. 4, the one or more positioning elements 80 comprises a plurality of depressions in the surface of the first support 10, said plurality of depressions located at regular intervals and forming a circle centred around the rotation axis RA of the rotatable shaft 37. A protrusion extending outwardly from the rotatable shaft 37 is provided with a protuberance 85 facing the surface of the first support 10 such that it can cooperate with the one or more positioning elements 80 to position the eccentric element 34 in the plurality of predetermined positions. Additionally, marks may be added to the one or more positioning elements 80 as a visual aid to the operator to determine the position of the moving means 30. Examples of marks may be letters, numbers, a scale.

Alternatively, the one or more positioning elements 80 may comprise one or more protuberances cooperating with at least one corresponding depression or protuberance. In yet another exemplary embodiment, the one or more positioning elements 80 may comprise a continuous ramp element, a spiral-shaped element centred around the rotation axis RA of the rotatable shaft 37, a linear or circular channel, and the like. In still yet another exemplary embodiment, the one or more positioning elements 80 may comprise one or more magnet elements and/or ferromagnetic materials such as to electromagnetically retain the moving means 30 in the plurality of predetermined positions. The one or more magnet elements and/or ferromagnetic materials may be configured to cooperate with a corresponding positioning member of the rotatable shaft 37 comprising a magnet element and/or a ferromagnetic material.

Figure 5A:
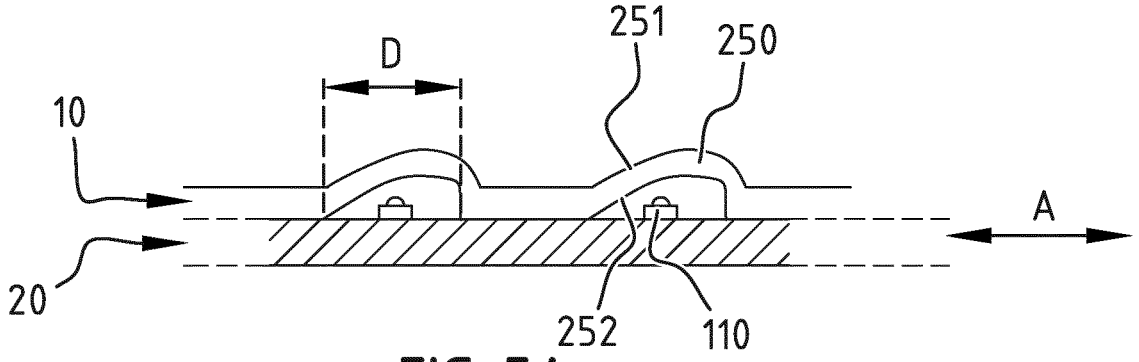
FIGS. 5A-5B illustrate cross-sectional views of other exemplary embodiments of lens elements of a luminaire system.
Figure 5B:
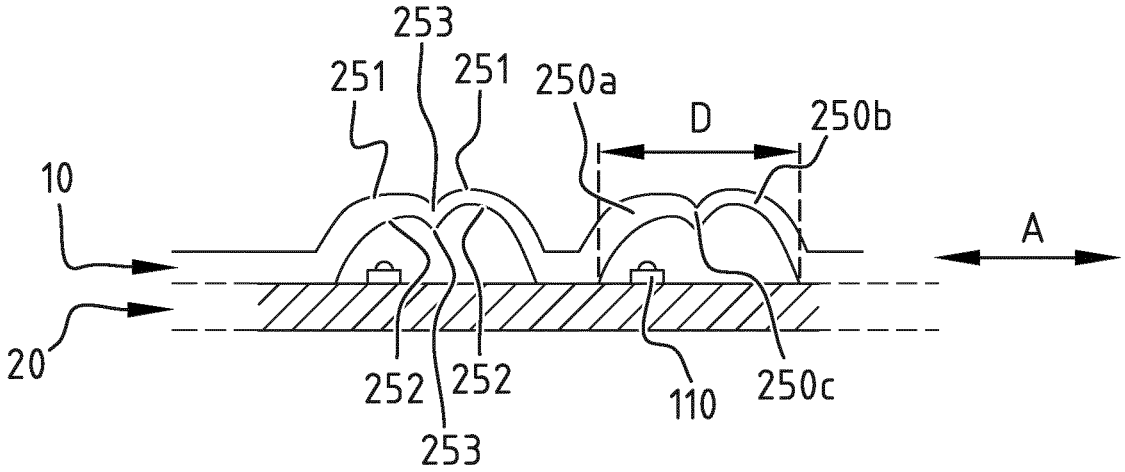

FIGS. 5A-5B illustrate cross-sectional views of other exemplary embodiments of lens elements of a luminaire system.

In the exemplary embodiments of FIGS. 5A-5B, the plurality of light sources 110, in the illustrated embodiments LEDs 110, is mounted on a PCB and the plurality of lens elements 250 is integrated in a lens plate. The lens plate is in contact with the PCB. Each of the plurality of lens elements 250 has a first surface 251 and a second surface 252 facing the plurality of light sources 110 opposite of the first surface 251. The first surface 251 is a convex surface and the second surface 252 is a concave surface. Each lens element of the plurality of lens elements 250 has a varying profile along an internal dimension D in the moving direction of the second support 20, i.e. along the trajectory A. The profile variation may be a shape variation along the internal dimension D of the lens element 250, a thickness variation between the first surface 251 and the second surface 252, and/or a variation of transparency and/or diffusivity and/or reflectivity and/or refractivity. In the embodiments of FIGS. 5A-5B, the trajectory A corresponds to a straight line along an axis A substantially parallel to the first support 10. In other embodiments, the trajectory A may correspond to a curved line substantially parallel to the first support 10.

In the exemplary embodiment of FIG. 5A, the luminaire system comprises a second support 20 comprising a plurality of light sources 110, and a first support 10 comprising a plurality of lens elements 250 associated with the plurality of light sources 110. The first support 10 may be fixed, and the second support 20 is movable with respect to the first support 10 along a trajectory A substantially parallel to the first support 10. A lens element of the plurality of lens elements 250 has a symmetry axis in the movement direction of the second support 20 along the trajectory A. The lens element 250 has a profile varying in thickness seen in the movement direction of the second support 20. The varying profile presents an asymmetric shape with respect to a centre plane perpendicular to the movement direction of the second support 20. Moving the lens plate to position the plurality of lens elements 250 in a plurality of positions will result in a plurality of lighting patterns on a surface, said plurality of lighting patterns having a plurality of different illuminated surface areas.

In the exemplary embodiment of FIG. 5B, the luminaire system comprises a first support 10 comprising a plurality of light sources 110, and a second support 20 comprising a plurality of lens elements 250 associated with the plurality of light sources 110. The first support 10 may be fixed, and the second support 20 is movable with respect to the first support 10 along a trajectory A substantially parallel to the first support 10. A lens element of the plurality of lens elements 250 has a first profile part 250*a* and a second profile part 250*b* adjoined in a discontinuous manner. In other words, the first profile part 250*a* and the second profile part 250*b* are connected through a connecting surface or line 250*c* comprising a saddle point 253 or discontinuity. The first profile part 250*a* presents a shape and a thickness variation along its length. The second profile part 250*b* presents a bell shape and a constant thickness along its length. Moving the plurality of light sources 110 such that the plurality of light sources 110 corresponds to the first profile part 250*a* or the second profile part 250*b* may further modify the lighting pattern obtained from the luminaire system. In the illustrated embodiment of FIG. 5B, the internal dimension D is defined as the added dimensions of the first and second profile part 250*a*, 250*b* on a side facing the plurality of light sources 110 along the movement direction of the second support 20. The second support 20 is movably arranged relative to the first support 10 to position the light sources 110 either in a first position facing the first profile part 250*a* or in a second position facing the second profile part 250*b*. Preferably, each lens element 250 has a circumferential edge in contact with the first support 100, and the connecting surface or line 250*c* is at a distance of the first support 10. Preferably, the first profile part 250*a* is at a first maximal distance of the first support 10, the second profile part 250*b* is at a second maximal distance of the first support 10, and the saddle point or discontinuity 253 is at a third distance of the first support 10, said third distance being lower than said first and second distance. More preferably, the first and second maximal distances are different.

FIGS. 6A-6E illustrate in more detail another embodiment of a "double bulged" lens element suitable for use in embodiments of the invention. The lens element 210 of FIGS. 6A-6E has an internal surface 210*b* facing a light source 110 and an external surface 210*a*. The internal surface 210*b* comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. The external surface 210*a* comprises a first curved surface 211*a* in the form of a first outwardly bulging surface and a second curved surface 212 in the form of a second outwardly bulging surface. The first curved surface 211*a* is connected to the second curved surface 212*a* through an external connecting surface or line 213*a* comprising a saddle point or discontinuity. The second support 20 is movable relative to said first support 10 such that the light source 110 can be in at least a first position P1 facing the first curved surfaces 211*a*, 211*b* or in at least a second position P2 facing the second curved surfaces 212*a*, 212*b*. The lens element 210 has a circumferential edge 218 in contact with the first support 10, and the internal connecting surface or line 213*b* is at a distance of the first support 10. In other words the lens element 210 moves in contact with the first support 10, and the distance between the internal connecting surface or line 213*b* and the first support allows the light source to pass underneath the connecting surface or line 213*b* when the second support 20 is moved from a first position where the light source 110 faces the first curved surfaces 211*a*, 211*b* to a second position where the light source 110 faces the second curved surfaces 212*a*, 212*b*. As is best visible in FIG. 6B, the external connecting surface 213*a* comprises a "line" portion in a central part, and two "surface" portions on either side of the "line" portion. Optionally, the external connecting surface 213*b* may be covered partially with a reflective coating, e.g. the hatched "surface" portions in the top view of FIG. 6B may be provided with a reflective coating.

Figure 6A:
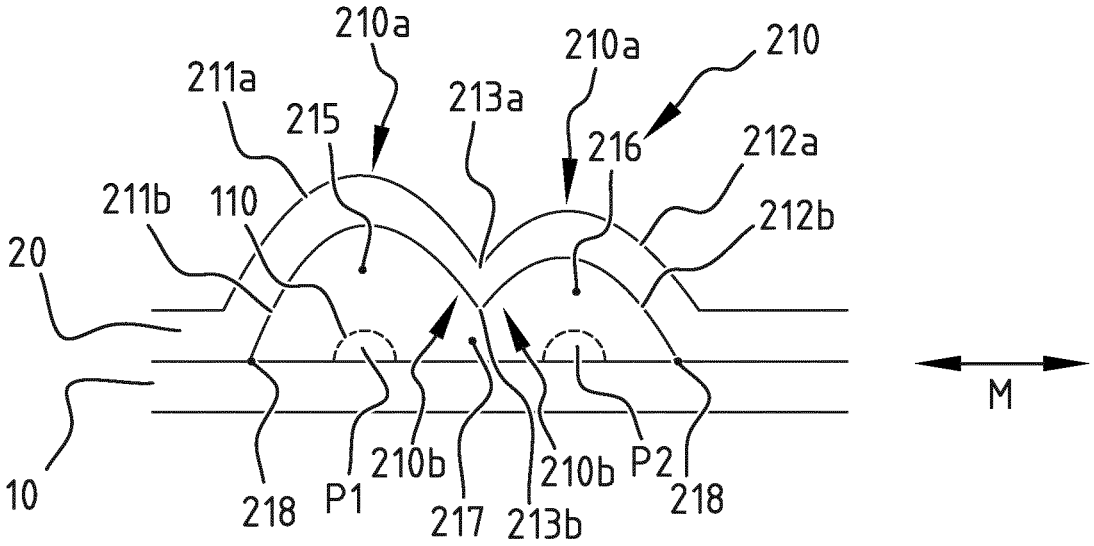
FIG. 6A shows a schematic cross-sectional view of another exemplary embodiment of a lens element.
Figure 6B:
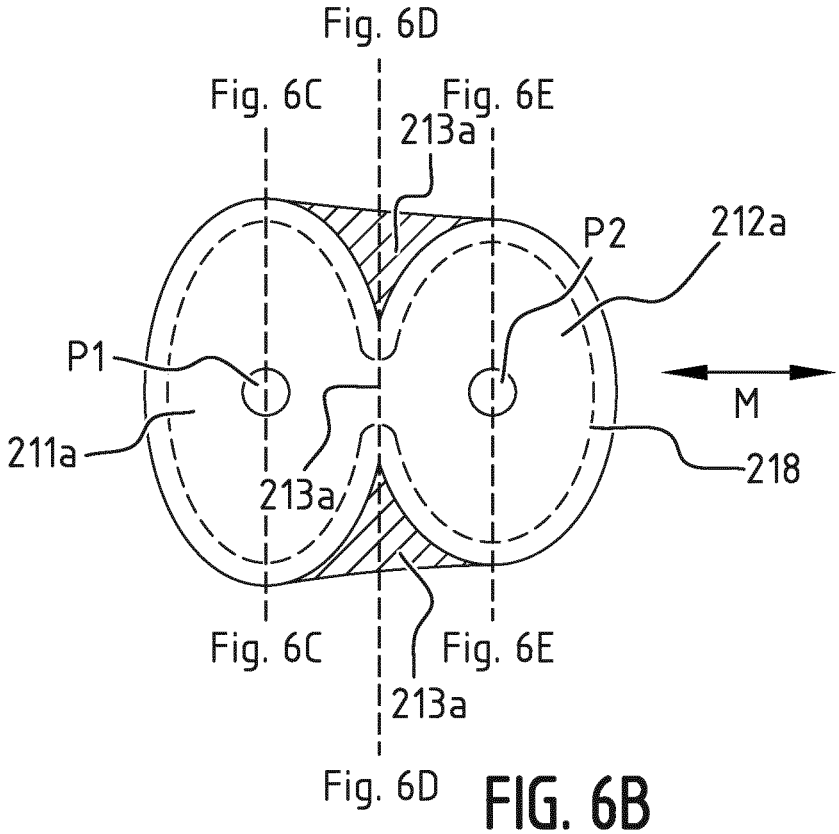
FIG. 6B shows a schematic top view of the lens element of FIG. 6A.
Figure 6C:
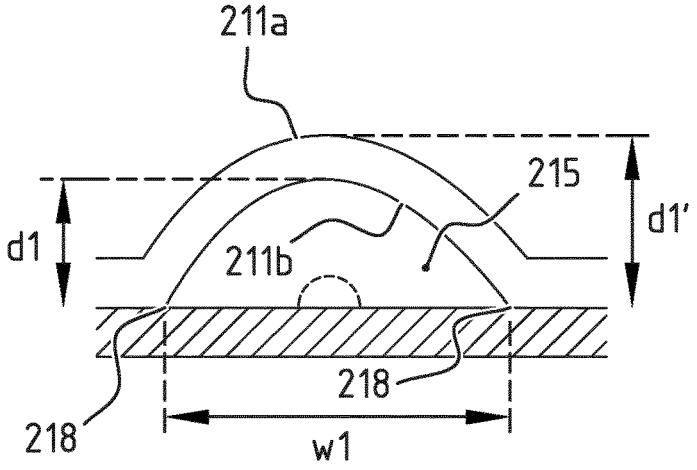
FIGS. 6C-6E are schematic cross-sectional views of the lens element along lines 6C-6C, 6D-6D, 6E-6E shown in FIG. 6B.
Figure 6D:
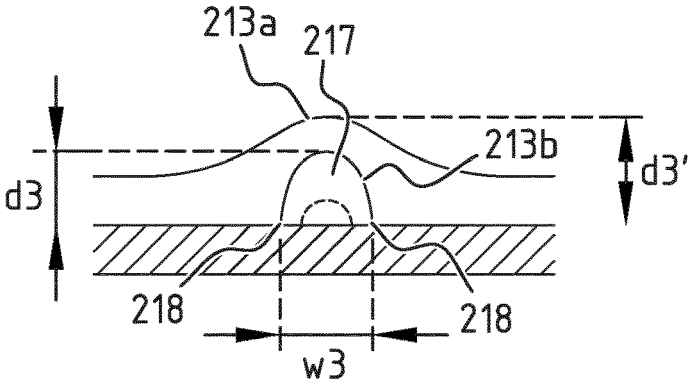
Figure 6E:
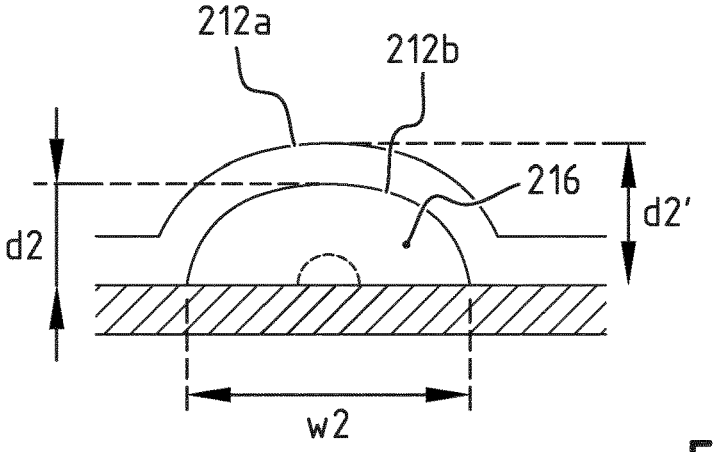

The first outwardly bulging surface 211*b* and the first support 10 delimit a first internal cavity 215, the second outwardly bulging surface 212*b* and the first support 10 delimit a second internal cavity 216, and the internal connecting surface or line 213*b* and the first support 10 delimit a connecting passage 217 between the first and second internal cavity. FIG. 6C shows a cross section along line 6C-6C in FIG. 6B, and illustrates that the first internal cavity 215 has a first maximal width w1, said first maximal width extending in a direction perpendicular on the moving direction M and measured in an upper plane of the first support 10. Similarly, FIG. 6D shows a cross section along line 6D-6D in FIG. 6B, and illustrates that the second internal cavity 216 has a second maximal width w2. FIG. 6E shows a cross section along line 6E-6E in FIG. 6B, and illustrates that the connecting passage 217 has a third minimal width w3. The first maximal width w1 and the second maximal width w2 are preferably larger than the third width w3. Also, the first maximal width w1 and the second maximal width w2 may be different. The first outwardly bulging surface 211*b* is at a first maximal distance d1 of the first support 10, the second outwardly bulging surface 212*b* is at a second maximal distance d2 of the first support 10, and the internal saddle point or discontinuity is at a third minimal distance d3 of the first support 10. The third minimal distance d3 may be lower than said first and second maximal distance d1, d2. Preferably, the first and second maximal distance d1, d2 are different. Similarly, the first outwardly bulging surface 211*a* is at a first maximal distance d1' of the first support 10, the second outwardly bulging surface 212*a* is at a second maximal distance d2' of the first support 10, and the external saddle point or discontinuity is at a third minimal distance d3' of the first support 10. The third minimal distance d3' may be lower than the first and second maximal distance d1', d2'. Preferably, the first and second maximal distance d1', d2' are different.

Whilst the principles of the invention have been set out above in connection with specific embodiments, it is to be understood that this description is merely made by way of example and not as a limitation of the scope of protection which is determined by the appended claims.

The invention claimed is:

1. A luminaire system comprising:

a first support;

a second support movable with respect to said first support;

wherein the first support and the second support are provided within a compartment of the luminaire system;

a moving means configured for moving the second support relative to the first support, such that a position of the second support with respect to the first support is changed;

wherein the moving means comprises a lever mounted in a rotatable manner around a rotation axis, said lever comprising a movable end portion configured for being rotated by a user or an actuator around said rotation axis, said movable end portion being located at a distance from the rotation axis;

wherein the lever extends through the compartment of the luminaire system such that the movable end portion can be moved from outside the compartment of the luminaire system;

wherein the moving means is further configured to convert a rotation of the lever around said rotation axis into a movement of the second support relative to the first support;

wherein a plurality of light sources is arranged on one of the first support and the second support, and is configured to emit light through one or more optical elements associated with the plurality of light sources and arranged on the other one of the first support and the second support;

wherein the movable end portion is an elongate element extending in a direction substantially perpendicular to the rotation axis;

wherein a leverage distance of the lever is at least five times larger than a maximum travel distance of the movement of the second support relative to the first support, said leverage distance being defined as the distance between an extremity of the movable end portion and the rotation axis of the lever.

2. The luminaire system according to claim 1, wherein the first support comprises said plurality of light sources and the second support comprises said one or more optical elements associated with the plurality of light sources.

3. The luminaire system according to claim 1, wherein a leverage distance between the movable end portion of the lever and the rotation axis is at least ten times larger than a maximum travel distance of the movement of the second support relative to the first support.

4. The luminaire system according to claim 1, further comprising one or more positioning elements; and wherein the moving means is configured for cooperating with the one or more positioning elements to position the second support with respect to the first support in a plurality of predetermined positions.

5. The luminaire system according to claim 1, wherein the movement of the second support with respect to the first support comprises a translational movement.

6. The luminaire system according to claim 1, wherein the movement of the second support with respect to the first support comprises a vertical movement.

7. The luminaire system according to claim 1, wherein the lever is coupled to the first or second support.

8. The luminaire system according to claim 7, wherein the lever comprises a rotatable shaft rotatably received in a recess of the first of second support.

9. The luminaire system according to claim 1, wherein the rotation axis of the lever is fixed with respect to the first support.

10. The luminaire system according to claim 1, wherein the rotation axis of the lever is substantially perpendicular to the movement plane of the second support with respect to the first support.

11. The luminaire system according to claim 1, wherein the lever extends through a passage in a wall of the compartment, said passage being provided with a sealing means configured for sealing the passage such that water ingress is prevented.

12. The luminaire system according to claim 1, further comprising a guiding means configured for guiding the movement of the second support with respect to the first support; wherein the guiding means preferably comprises a plurality of elongated guiding holes located in the first or second support.

13. The luminaire system according to claim 1, wherein the lever comprises an eccentric element cooperating with a guiding element of the first or second support, said eccentric element being centered around an eccentric axis parallel to the rotation axis of the lever.

14. The luminaire system according to claim 1, wherein the movable end portion comprises a ferromagnetic material or a magnet; and wherein the lever and the luminaire system are configured such that the lever is rotatable by means of a magnet element or a ferromagnetic material outside the compartment of the luminaire system.

15. A luminaire system assembly comprising:

a luminaire system according to claim 14;

an actuating key comprising a magnet element or a ferromagnetic material, said actuating key being configured for rotating the lever around the rotation axis.

16. A method for actuating a moving means of a luminaire system assembly according to claim 15, the method comprising:

positioning an actuating key at a first position outside a luminaire head of the luminaire system, such that the actuating key is being coupled electromagnetically to the movable end portion of the lever;

moving the actuating key from the first position to a second position outside the compartment of the luminaire system, such that the movable end portion of the lever is rotated around the rotation axis; and optionally, removing the actuating key from the second position outside the compartment of the luminaire system, such that the magnet element or the ferromagnetic material of the actuating key is electromagnetically decoupled from the ferromagnetic material or the magnet element comprised in the movable end portion of the lever.

17. A luminaire system comprising:

a first support;

a second support movable with respect to said first support;

one or more positioning elements;

wherein the first support and the second support are provided within a compartment of the luminaire system;

a moving means configured for moving the second support relative to the first support, such that a position of the second support with respect to the first support is changed;

wherein the moving means comprises a lever mounted in a rotatable manner around a rotation axis, said lever comprising a movable end portion configured for being rotated by a user or an actuator around said rotation axis, said movable end portion being located at a distance from the rotation axis;

wherein the lever extends through the compartment of the luminaire system such that the movable end portion can be moved from outside the compartment of the luminaire system;

wherein the moving means is further configured to convert a rotation of the lever around said rotation axis into a movement of the second support relative to the first support;

wherein a plurality of light sources is arranged on one of the first support and the second support, and is configured to emit light through one or more lens elements associated with the plurality of light sources and arranged on the other one of the first support and the second support;

wherein the moving means is configured for cooperating with the one or more positioning elements to position the second support with respect to the first support in a plurality of predetermined positions, said predetermined positions corresponding with a plurality of lighting patterns on a surface resulting from a plurality of different light distributions, said plurality of lighting patterns having a plurality of different illuminated surface areas, respectively.

18. A luminaire system comprising:

a first support;

a second support movable with respect to said first support;

wherein the first support and the second support are provided within a compartment of the luminaire system;

a moving means configured for moving the second support relative to the first support, such that a position of the second support with respect to the first support is changed;

wherein the moving means comprises a lever mounted in a rotatable manner around a rotation axis, said lever comprising a movable end portion configured for being rotated by a user or an actuator around said rotation axis, said movable end portion being located at a distance from the rotation axis;

wherein the lever extends through the compartment of the luminaire system such that the movable end portion can be moved from outside the compartment of the luminaire system;

wherein the moving means is further configured to convert a rotation of the lever around said rotation axis into a movement of the second support relative to the first support;

wherein a plurality of light sources is arranged on one of the first support and the second support, and is configured to emit light through one or more lens elements associated with the plurality of light sources and integrated in an optical plate comprised by the other one of the first support and the second support;

wherein the movement of the second support with respect to the first support comprises a translational movement.

* * * * *